US011746768B2

(12) United States Patent
Gong et al.

(10) Patent No.: US 11,746,768 B2
(45) Date of Patent: Sep. 5, 2023

(54) LINEAR COMPRESSOR

(71) Applicant: LG Electronics Inc., Seoul (KR)

(72) Inventors: Sungchul Gong, Seoul (KR); Kiwon Noh, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 17/401,082

(22) Filed: Aug. 12, 2021

(65) Prior Publication Data

US 2022/0170450 A1 Jun. 2, 2022

(30) Foreign Application Priority Data

Dec. 2, 2020 (KR) ..... 10-2020-0166784

(51) Int. Cl.
*F04B 39/12* (2006.01)

(52) U.S. Cl.
CPC ..... *F04B 39/125* (2013.01)

(58) Field of Classification Search
CPC ..... F04B 35/045; F04B 39/12; F04B 39/125
See application file for complete search history.

(56) References Cited

U.S. PATENT DOCUMENTS

| | | | | |
|---|---|---|---|---|
| 6,824,365 | B2 * | 11/2004 | Park | F04B 39/0061 181/403 |
| 2017/0204841 | A1 * | 7/2017 | Jeon | F04B 39/10 |
| 2017/0321681 | A1 * | 11/2017 | Lee | F04B 39/121 |
| 2019/0107312 | A1 * | 4/2019 | Noh | F04B 19/04 |
| 2019/0353154 | A1 * | 11/2019 | Kim | F04B 39/0005 |

FOREIGN PATENT DOCUMENTS

| | | |
|---|---|---|
| CN | 107339217 | 11/2017 |
| EP | 3196460 | 7/2017 |
| EP | 3587811 | 1/2020 |
| EP | 3617515 | 3/2020 |
| KR | 100314036 | 11/2001 |
| KR | 100396776 | 9/2003 |
| KR | 20170124903 | 11/2017 |
| KR | 20190040812 | 4/2019 |
| KR | 20190118426 | 10/2019 |

OTHER PUBLICATIONS

Notice of Allowance in Korean Application No. 10-2020-0166784, dated Jul. 8, 2022, 4 pages (with English translation).
Extended European Search Report in European Appln. No. 21190462.8, dated Dec. 16, 2021, 8 pages.
Office Action in Chinese Appln. No. 202111080567.0, dated Apr. 28, 2022, 14 pages(with English translation).

* cited by examiner

*Primary Examiner* — Thomas Fink
(74) *Attorney, Agent, or Firm* — Fish & Richardson P.C.

(57) ABSTRACT

A linear compressor includes a frame, a cylinder disposed in the frame, a piston disposed in the cylinder and configured to reciprocate relative to the cylinder along an axis of the cylinder, a discharge valve disposed forward relative to the piston, and a discharge cover assembly coupled to the frame and disposed forward relative to the piston. The discharge cover assembly includes a discharge cover forming an inner space, a first discharge plenum disposed in the discharge cover and configured to partition the inner space into a plurality of discharge spaces, and a second discharge plenum disposed forward relative to the first discharge plenum and being in close contact with an inner surface of the discharge cover.

16 Claims, 13 Drawing Sheets

LINEAR COMPRESSOR

CROSS-REFERENCE TO RELATED APPLICATIONS

This application claims the benefit of Korea Patent Application No. 10-2020-0166784, filed on Dec. 2, 2020, which is incorporated herein by reference for all purposes as if fully set forth herein.

TECHNICAL FIELD

The present disclosure relates to a linear compressor. More specifically, the present disclosure relates to a linear compressor for compressing a refrigerant by a linear reciprocating motion of a piston.

BACKGROUND

In general, a compressor refers to a device that is configured to receive power from a power generator such as a motor or a turbine and compress a working fluid such as air or refrigerant. More specifically, the compressors are widely used in the whole industry or home appliances, such as for a steam compression refrigeration cycle (hereinafter, referred to as "refrigeration cycle").

The compressors may be classified into a reciprocating compressor, a rotary compressor, and a scroll compressor according to a method of compressing the refrigerant.

The reciprocating compressor uses a method in which a compression space is formed between a piston and a cylinder, and the piston linearly reciprocates to compress a fluid. The rotary compressor uses a method of compressing a fluid by a roller that eccentrically rotates inside a cylinder. The scroll compressor uses a method of compressing a fluid by engaging and rotating a pair of spiral scrolls.

Recently, among the reciprocating compressors, the use of linear compressors that uses a linear reciprocating motion without using a crank shaft is gradually increasing. The linear compressor has advantages in that it has less mechanical loss resulting from switching a rotary motion to the linear reciprocating motion and thus can improve the efficiency, and has a relatively simple structure.

The linear compressor is configured such that a cylinder is positioned in a casing forming a sealed space to define a compression chamber, and a piston covering the compression chamber reciprocates in the cylinder. The linear compressor repeats a process in which a fluid in the sealed space is sucked into the compression chamber while the piston is positioned at a bottom dead center (BDC), and the fluid of the compression chamber is compressed and discharged while the piston is positioned at a top dead center (TDC).

A compression unit and a drive unit are installed inside the linear compressor. The compression unit performs a process of compressing and discharging a refrigerant while performing a resonant motion by a resonant spring through a movement generated in the drive unit.

The piston of the linear compressor repeatedly performs a series of processes of sucking the refrigerant into the casing through an intake pipe while reciprocating at high speed inside the cylinder by the resonant spring, and then discharging the refrigerant from a compression space through a forward movement of the piston to move it to a condenser through a discharge pipe.

The linear compressor may be classified into an oil lubricated linear compressor and a gas lubricated linear compressor according to a lubrication method.

The oil lubricated linear compressor is configured to store a predetermined amount of oil in the casing and lubricate between the cylinder and the piston using the oil.

On the other hand, the gas lubricated linear compressor is configured not to store an oil in the casing, induce a part of the refrigerant discharged from the compression space between the cylinder and the piston, and lubricate between the cylinder and the piston by a gas force of the refrigerant.

The oil lubricated linear compressor supplies the oil of a relatively low temperature between the cylinder and the piston and thus can suppress the cylinder and the piston from being overheated by motor heat or compression heat, etc. Hence, the oil lubricated linear compressor suppresses specific volume from increasing as the refrigerant passing through an intake flow path of the piston is sucked into the compression chamber of the cylinder and is heated, and thus can prevent in advance an intake loss from occurring.

However, when the refrigerant and an oil discharged to a refrigeration cycle device are not smoothly returned to the compressor, the oil lubricated linear compressor may experience an oil shortage in the casing of the compressor. The oil shortage in the casing may lead to a reduction in reliability of the compressor.

On the other hand, the gas lubricated linear compressor has advantages in that it can be made smaller than the oil lubricated linear compressor, and there is no reduction in the reliability of the compressor due to the oil shortage because it lubricates between the cylinder and the piston using the refrigerant.

Such a linear compressor is disclosed in Korean Patent Application Publication No. 10-2017-0124903 (hereinafter. 'prior art document 1').

The prior art document 1 discloses a linear compressor comprising a frame coupled to a cylinder, a gas hole formed in the frame, and a gas pocket that communicates with the gas hole and transfers a refrigerant gas to the inside of the cylinder. The refrigerant gas serves as a gas bearing between the cylinder and a piston and can reduce a friction force.

The prior art document 1 has a problem in that a refrigerant, that is discharged from a discharge valve and flows in a discharge cover, directly contacts an inner surface of the discharge cover and is heat exchanged with a refrigerant inside a shell.

Hence, there is a problem in that efficiency of the refrigerant is reduced due to a decrease in a temperature of the refrigerant flowing in the discharge cover.

In addition, there is a problem in that the refrigerant flowing in the discharge cover is supplied to the gas bearing while repeating compression and expansion.

Hence, when the refrigerant repeating compression and expansion serves as the gas bearing, a pressure reduction occurs, leading to reduction in efficiency of the gas bearing.

PRIOR ART DOCUMENT (Patent Document 1) Korean Patent Application Publication No. 10-2017-0124903 (published on Nov. 13, 2017)

(Patent Document 2) Korean Patent No. 10-0314036 (published on Nov. 15, 2001)

(Patent Document 3) Korean Patent No. 10-0396776 (published on Sep. 3, 2003)

SUMMARY

An object of the present disclosure is to provide a linear compressor capable of preventing a refrigerant flowing in a discharge cover from being heat exchanged with a refrigerant in a shell by preventing the refrigerant flowing in the discharge cover from directly contacting an inner surface of the discharge cover.

An object of the present disclosure is to also provide a linear compressor capable of preventing a reduction in efficiency of a refrigerant flowing in a discharge cover due to a decrease in a temperature of the refrigerant flowing in the discharge cover.

An object of the present disclosure is to also provide a linear compressor capable of increasing a sealed area of an inner surface of a discharge cover by maximizing a contact area between a discharge plenum and the inner surface of the discharge cover.

An object of the present disclosure is to also provide a linear compressor capable of improving efficiency of a gas bearing by preventing compression and expansion generated in a process of supplying a refrigerant flowing in a discharge cover to the gas bearing.

An object of the present disclosure is to also provide a linear compressor capable of improving efficiency of a gas bearing by preventing a leakage of a refrigerant flowing from a second bearing communication hole to a first bearing communication hole.

An object of the present disclosure is to also provide a linear compressor capable of improving efficiency of a gas bearing by preventing compression and expansion that may occur in a process of supplying a refrigerant flowing in a discharge cover to a first bearing.

An object of the present disclosure is to also provide a linear compressor capable of improving efficiency of a gas bearing by preventing a refrigerant flowing from a second bearing communication hole to a first bearing communication hole from leaking into a space between a frame and a discharge cover.

An object of the present disclosure is to also provide a linear compressor capable of improving efficiency of a gas bearing by minimizing a flow path of a refrigerant passing through a second bearing communication hole.

An object of the present disclosure is to also provide a linear compressor capable of improving efficiency of preventing a refrigerant flowing in a plurality of discharge spaces from directly contacting an inner surface of a discharge cover by minimizing a contact area between first and second discharge plenums and the inner surface of the discharge cover.

An object of the present disclosure is to also provide a linear compressor capable of minimizing a direct contact between a refrigerant flowing in a plurality of discharge spaces and an inner surface of a discharge cover by minimizing a separation space between a first discharge plenum and a second discharge plenum.

An object of the present disclosure is to also provide a linear compressor capable of preventing a refrigerant passing through a discharge valve and/or a plurality of discharge spaces from leaking into a space between a frame and a discharge cover.

To achieve the above-described and other objects, in one aspect of the present disclosure, there is provided a linear compressor comprising a frame; a cylinder disposed in the frame; a piston disposed in the cylinder and configured to reciprocate relative to the cylinder along an axis of the cylinder; a discharge valve disposed forward relative to the piston; and a discharge cover assembly coupled to the frame and disposed forward relative to the piston, wherein the discharge cover assembly comprises a discharge cover forming an inner space, a first discharge plenum disposed in the discharge cover and configured to partition the inner space into a plurality of discharge spaces, and a second discharge plenum disposed forward relative to the first discharge plenum and being in close contact with an inner surface of the discharge cover.

Hence, the present disclosure can prevent a refrigerant flowing in a discharge cover from being heat exchanged with a refrigerant in a shell by preventing the refrigerant flowing in the discharge cover from directly contacting an inner surface of the discharge cover.

As a result, the present disclosure can prevent a reduction in efficiency of a refrigerant flowing in the discharge cover due to a decrease in a temperature of the refrigerant flowing in the discharge cover.

The discharge cover may comprise a first discharge hole that communicates the inner space with an outside, and the second discharge plenum may comprise a second discharge hole that communicates the plurality of discharge spaces with the first discharge hole.

In this case, the inner surface of the discharge cover may be sealed by the first discharge plenum and the second discharge plenum in an area other than an area in which the second discharge hole is disposed.

Hence, the present disclosure can increase a sealed area of the inner surface of the discharge cover by maximizing a contact area between the second discharge plenum and the inner surface of the discharge cover. As a result, the present disclosure can prevent a decrease in the temperature of the refrigerant flowing in the discharge cover.

The frame may comprise a first bearing communication hole that connects a front surface to an inner surface, and the discharge cover may comprise a second bearing communication hole that connects the inner surface to a rear surface and faces the first bearing communication hole.

Hence, the present disclosure can prevent compression and expansion generated in a process of supplying a refrigerant flowing in the discharge cover to the gas bearing.

As a result, the present disclosure can prevent a pressure drop generated when the refrigerant repeating the compression and expansion serves as the gas bearing, and improve efficiency of the gas bearing.

The second bearing communication hole may communicate with the first discharge hole and the second discharge hole.

Hence, the present disclosure can prevent a leakage of a refrigerant flowing from the second bearing communication hole to the first bearing communication hole.

A diameter of the second bearing communication hole may correspond to a diameter of the first bearing communication hole.

Hence, the present disclosure can prevent compression and expansion generated in a process of supplying a refrigerant flowing in the discharge cover to a first bearing. As a result, the present disclosure can prevent a pressure drop of the refrigerant serving as the gas bearing and improve efficiency of the gas bearing.

The linear compressor may further comprise a first sealing member disposed between the frame and the discharge cover and configured to prevent a refrigerant passing through the first bearing communication hole from leaking into a space between the frame and the discharge cover.

Hence, the present disclosure can improve efficiency of the gas bearing by preventing a refrigerant flowing from the second bearing communication hole to the first bearing communication hole from leaking into the space between the frame and the discharge cover.

The second bearing communication hole may have a predetermined angle with respect to the rear surface of the discharge cover.

Hence, the present disclosure can improve efficiency of the gas bearing by minimizing a flow path of a refrigerant passing through the second bearing communication hole.

The linear compressor may further comprise a second sealing member disposed between the frame and the discharge cover and configured to prevent a refrigerant of the plurality of discharge spaces from leaking into a space between the frame and the discharge cover.

Hence, the present disclosure can improve efficiency of a refrigerant by preventing the refrigerant passing through the discharge valve and/or the plurality of discharge spaces from leaking into the space between the frame and the discharge cover.

In another aspect of the present disclosure, there is provided a linear compressor comprising a frame; a cylinder disposed in the frame; a piston disposed in the cylinder and configured to reciprocate relative to the cylinder along an axis of the cylinder; a discharge valve disposed forward relative to the piston; and a discharge cover assembly coupled to the frame and disposed forward relative to the piston, wherein the discharge cover assembly comprises a discharge cover forming an inner space, a first discharge plenum disposed in the discharge cover, configured to partition the inner space into a plurality of discharge spaces, and being in close contact with an inner surface of the discharge cover, and a second discharge plenum disposed forward relative to the first discharge plenum and being in close contact with the inner surface of the discharge cover.

Hence, the present disclosure can prevent a refrigerant flowing in a discharge cover from being heat exchanged with a refrigerant in a shell by preventing the refrigerant flowing in the discharge cover from directly contacting an inner surface of the discharge cover.

As a result, the present disclosure can prevent a reduction in efficiency of a refrigerant flowing in the discharge cover due to a decrease in a temperature of the refrigerant flowing in the discharge cover.

The discharge cover may comprise a first discharge hole that communicates the inner space with an outside, and the second discharge plenum may comprise a second discharge hole that communicates the plurality of discharge spaces with the first discharge hole.

In this case, the inner surface of the discharge cover may be sealed by the first discharge plenum and the second discharge plenum in an area other than an area in which the second discharge hole is disposed.

Hence, the present disclosure can increase a sealed area of the inner surface of the discharge cover by maximizing a contact area between the second discharge plenum and the inner surface of the discharge cover. As a result, the present disclosure can prevent a decrease in the temperature of the refrigerant flowing in the discharge cover.

The frame may comprise a first bearing communication hole that connects a front surface to an inner surface, and the discharge cover may comprise a second bearing communication hole that connects the inner surface to a rear surface and faces the first bearing communication hole.

Hence, the present disclosure can prevent compression and expansion generated in a process of supplying a refrigerant flowing in the discharge cover to the gas bearing.

As a result, the present disclosure can prevent a pressure drop generated when the refrigerant repeating the compression and expansion serves as the gas bearing, and improve efficiency of the gas bearing.

The second bearing communication hole may communicate with the first discharge hole and the second discharge hole.

Hence, the present disclosure can prevent a leakage of a refrigerant flowing from the second bearing communication hole to the first bearing communication hole.

A diameter of the second bearing communication hole may correspond to a diameter of the first bearing communication hole.

Hence, the present disclosure can prevent compression and expansion generated in a process of supplying a refrigerant flowing in the discharge cover to a first bearing. As a result, the present disclosure can prevent a pressure drop of the refrigerant serving as the gas bearing and improve efficiency of the gas bearing.

The linear compressor may further comprise a first sealing member disposed between the frame and the discharge cover and configured to prevent a refrigerant passing through the first bearing communication hole from leaking into a space between the frame and the discharge cover.

Hence, the present disclosure can improve efficiency of the gas bearing by preventing a refrigerant flowing from the second bearing communication hole to the first bearing communication hole from leaking into the space between the frame and the discharge cover.

The second bearing communication hole may have a predetermined angle with respect to the rear surface of the discharge cover.

Hence, the present disclosure can improve efficiency of the gas bearing by minimizing a flow path of a refrigerant passing through the second bearing communication hole.

The first discharge plenum may comprise a first contact member being in close contact with the inner surface of the discharge cover, and at least one partition member partitioning the inner space into the plurality of discharge spaces. The second discharge plenum may be disposed forward relative to the first contact member and may be in close contact with the inner surface of the discharge cover.

Hence, the present disclosure can minimize a contact area between the first and second discharge plenums and the inner surface of the discharge cover, and thus minimize a direct contact between a refrigerant flowing in the plurality of discharge spaces and the inner surface of the discharge cover.

The first discharge plenum may comprise a coupling groove between the first contact member and the at least one partition member, and a rear end of the second discharge plenum may be disposed in the coupling groove.

Hence, the present disclosure can minimize a separation space between the first discharge plenum and the second discharge plenum, and thus minimize a direct contact between a refrigerant flowing in the plurality of discharge spaces and the inner surface of the discharge cover.

The linear compressor may further comprise a second sealing member disposed between the frame and the discharge cover and configured to prevent a refrigerant of the plurality of discharge spaces from leaking into a space between the frame and the discharge cover.

Hence, the present disclosure can improve efficiency of a refrigerant by preventing the refrigerant passing through the discharge valve and/or the plurality of discharge spaces from leaking into the space between the frame and the discharge cover.

According to at least one aspect, the present disclosure can provide a linear compressor capable of preventing a refrigerant flowing in a discharge cover from being heat exchanged with a refrigerant in a shell by preventing the refrigerant flowing in the discharge cover from directly contacting an inner surface of the discharge cover.

According to at least one aspect, the present disclosure can provide a linear compressor capable of preventing a reduction in efficiency of a refrigerant flowing in a discharge cover due to a decrease in a temperature of the refrigerant flowing in the discharge cover.

According to at least one aspect, the present disclosure can provide a linear compressor capable of increasing a sealed area of an inner surface of a discharge cover by maximizing a contact area between a discharge plenum and the inner surface of the discharge cover.

According to at least one aspect, the present disclosure can provide a linear compressor capable of improving efficiency of a gas bearing by preventing compression and expansion generated in a process of supplying a refrigerant flowing in a discharge cover to the gas bearing.

According to at least one aspect, the present disclosure can provide a linear compressor capable of improving efficiency of a gas bearing by preventing a leakage of a refrigerant flowing from a second bearing communication hole to a first bearing communication hole.

According to at least one aspect, the present disclosure can provide a linear compressor capable of improving efficiency of a gas bearing by preventing compression and expansion that may occur in a process of supplying a refrigerant flowing in a discharge cover to a first bearing.

According to at least one aspect, the present disclosure can provide a linear compressor capable of improving efficiency of a gas bearing by preventing a refrigerant flowing from a second bearing communication hole to a first bearing communication hole from leaking into a space between a frame and a discharge cover.

According to at least one aspect, the present disclosure can provide a linear compressor capable of improving efficiency of a gas bearing by minimizing a flow path of a refrigerant passing through a second bearing communication hole.

According to at least one aspect, the present disclosure can provide a linear compressor capable of improving efficiency of preventing a refrigerant flowing in a plurality of discharge spaces from directly contacting an inner surface of a discharge cover by minimizing a contact area between first and second discharge plenums and the inner surface of the discharge cover.

According to at least one aspect, the present disclosure can provide a linear compressor capable of minimizing a direct contact between a refrigerant flowing in a plurality of discharge spaces and an inner surface of a discharge cover by minimizing a separation space between a first discharge plenum and a second discharge plenum.

According to at least one aspect, the present disclosure can provide a linear compressor capable of preventing a refrigerant passing through a discharge valve and/or a plurality of discharge spaces from leaking into a space between a frame and a discharge cover.

BRIEF DESCRIPTION OF THE DRAWINGS

The accompanying drawings, which are included to provide a further understanding of the present disclosure and constitute a part of the detailed description, illustrate embodiments of the present disclosure and serve to explain technical features of the present disclosure together with the description.

DETAILED DESCRIPTION

Reference will now be made in detail to embodiments of the present disclosure, examples of which are illustrated in the accompanying drawings. Wherever possible, the same reference numbers will be used throughout the drawings to refer to the same or like parts.

It should be understood that when a component is described as being "connected to" or "coupled to" other component, it may be directly connected or coupled to the other component or intervening component(s) may be present.

It will be noted that a detailed description of known arts will be omitted if it is determined that the detailed description of the known arts can obscure embodiments of the present disclosure. The accompanying drawings are used to help easily understand various technical features and it should be understood that embodiments presented herein are not limited by the accompanying drawings. As such, the present disclosure should be understand to extend to any alterations, equivalents and substitutes in addition to those which are particularly set out in the accompanying drawings.

In addition, a term of "disclosure" may be replaced by document, specification, description, etc.

Figure 1:
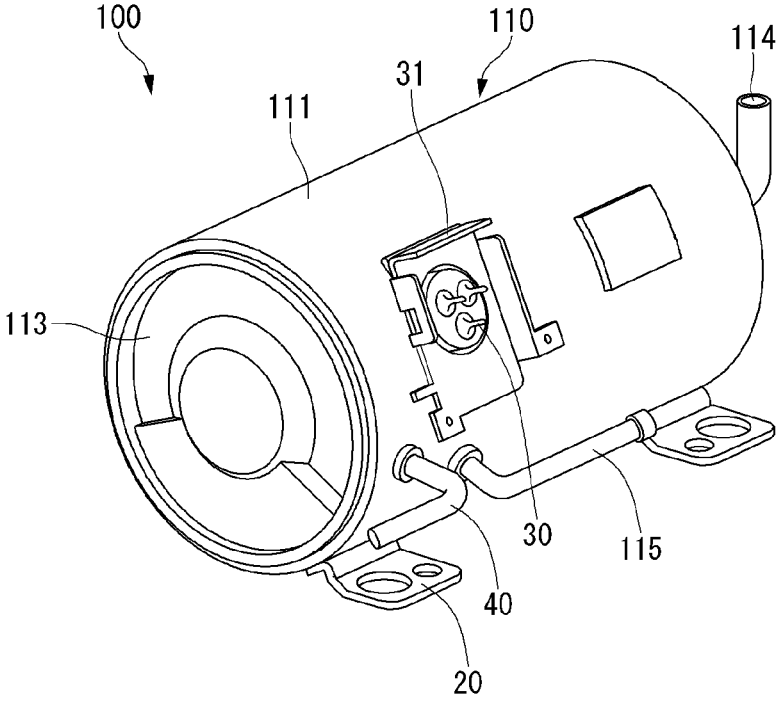
FIG. 1 is a perspective view of a linear compressor according to an embodiment of the present disclosure.

FIG. 1 is a perspective view of a linear compressor according to an embodiment of the present disclosure.

Referring to FIG. 1, a linear compressor 100 according to an embodiment of the present disclosure may include a shell 111 and shell covers 112 and 113 coupled to the shell 111. In a broad sense, the shell covers 112 and 113 can be understood as one configuration of the shell 111.

Legs 20 may be coupled to a lower side of the shell 111. The legs 20 may be coupled to a base of a product on which the linear compressor 100 is mounted. For example, the product may include a refrigerator, and the base may include a machine room base of the refrigerator. As another example, the product may include an outdoor unit of an air conditioner, and the base may include a base of the outdoor unit.

The shell 111 may have a substantially cylindrical shape and may be disposed to lie in a horizontal direction or an axial direction. FIG. 1 illustrates that the shell 111 is extended in the horizontal direction and has a slightly low height in a radial direction, by way of example. That is, since the linear compressor 100 can have a low height, there is an advantage in that a height of the machine room can decrease when the linear compressor 100 is installed in, for example, the machine room base of the refrigerator.

A longitudinal central axis of the shell 111 may coincide with a central axis of a main body of the compressor 100 to be described below, and the central axis of the main body of the compressor 100 may coincide with a central axis of a cylinder 140 and a piston 150 that constitute the main body of the compressor 100.

A terminal 30 may be installed on an outer surface of the shell 111. The terminal 30 may transmit external electric power to a drive unit 130 of the linear compressor 100. More specifically, the terminal 30 may be connected to a lead line of a coil 132*b*.

A bracket 31 may be installed on the outside of the terminal 30. The bracket 31 may include a plurality of brackets surrounding the terminal 30. The bracket 31 may perform a function of protecting the terminal 30 from an external impact, etc.

Both sides of the shell 111 may be opened. The shell covers 112 and 113 may be coupled to both sides of the opened shell 111. More specifically, the shell covers 112 and 113 may include a first shell cover 112 coupled to one opened side of the shell 111 and a second shell cover 113 coupled to the other opened side of the shell 111. An inner space of the shell 111 may be sealed by the shell covers 112 and 113.

FIG. 1 illustrates that the first shell cover 112 is positioned on the right side of the linear compressor 100, and the second shell cover 113 is positioned on the left side of the linear compressor 100, by way of example. In other words, the first and second shell covers 112 and 113 may be disposed to face each other. It can be understood that the first shell cover 112 is positioned on an intake side of a refrigerant, and the second shell cover 113 is positioned on a discharge side of the refrigerant.

The linear compressor 100 may include a plurality of pipes 114, 115, and 40 that are included in the shell 111 or the shell covers 112 and 113 and can suck, discharge, or inject the refrigerant.

The plurality of pipes 114, 115, and 40 may include an intake pipe 114 that allows the refrigerant to be sucked into the linear compressor 100, a discharge pipe 115 that allows the compressed refrigerant to be discharged from the linear compressor 100, and a supplementary pipe 40 for supplementing the refrigerant in the linear compressor 100.

For example, the intake pipe 114 may be coupled to the first shell cover 112. The refrigerant may be sucked into the linear compressor 100 along the axial direction through the intake pipe 114.

The discharge pipe 115 may be coupled to an outer circumferential surface of the shell 111. The refrigerant sucked through the intake pipe 114 may be compressed while flowing in the axial direction. The compressed refrigerant may be discharged through the discharge pipe 115. The discharge pipe 115 may be disposed closer to the second shell cover 113 than to the first shell cover 112.

The supplementary pipe 40 may be coupled to the outer circumferential surface of the shell 111. A worker may inject the refrigerant into the linear compressor 100 through the supplementary pipe 40.

The supplementary pipe 40 may be coupled to the shell 111 at a different height from the discharge pipe 115 in order to prevent interference with the discharge pipe 115. Herein, the height may be understood as a distance measured from the leg 20 in a vertical direction. Because the discharge pipe 115 and the supplementary pipe 40 are coupled to the outer circumferential surface of the shell 111 at different heights, the work convenience can be attained.

On an inner circumferential surface of the shell 111 corresponding to a location at which the supplementary pipe 40 is coupled, at least a portion of the second shell cover 113 may be positioned adjacently. In other words, at least a portion of the second shell cover 113 may act as a resistance of the refrigerant injected through the supplementary pipe 40.

Thus, with respect to a flow path of the refrigerant, a size of the flow path of the refrigerant introduced through the supplementary pipe 40 may be configured to decrease by the second shell cover 113 while the refrigerant enters into the inner space of the shell 111, and again increase while the refrigerant passes through the second shell cover 113. In this process, a pressure of the refrigerant may be reduced to vaporize the refrigerant, and an oil contained in the refrigerant may be separated. Thus, while the refrigerant, from which the oil is separated, is introduced into the piston 150, a compression performance of the refrigerant can be improved. The oil may be understood as a working oil present in a cooling system.

Figure 2:
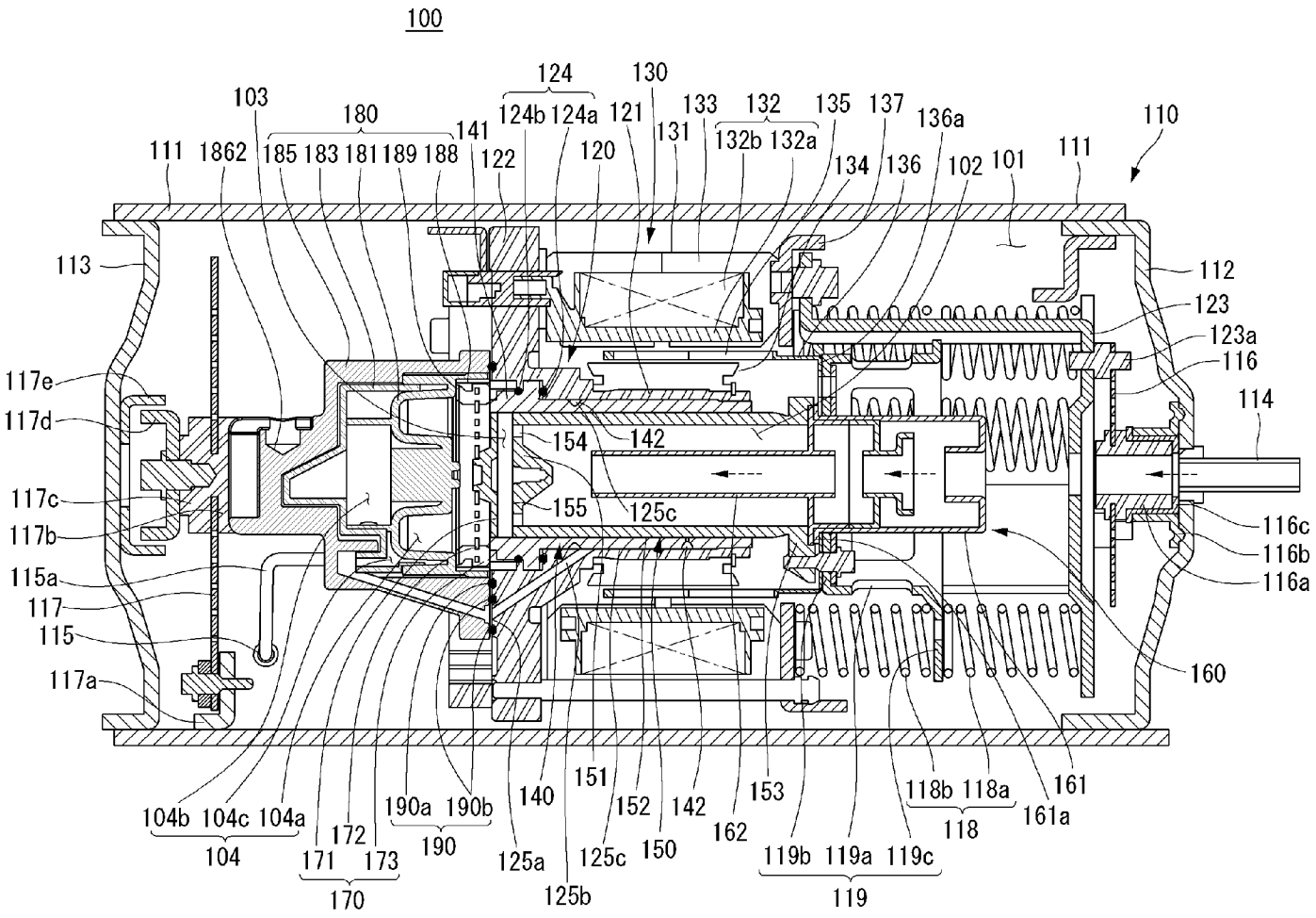
FIG. 2 is a cross-sectional view of a linear compressor according to an embodiment of the present disclosure.

FIG. 2 is a cross-sectional view illustrating a structure of the linear compressor 100.

Hereinafter, the linear compressor 100 according to the present disclosure will be described taking, as an example, a linear compressor that sucks and compresses a fluid while a piston linearly reciprocates, and discharges the compressed fluid.

The linear compressor may be a component of a refrigeration cycle, and the fluid compressed in the linear compressor may be a refrigerant circulating the refrigeration cycle. The refrigeration cycle may include a condenser, an expander, an evaporator, etc., in addition to the compressor. The linear compressor may be used as a component of the cooling system of the refrigerator, but is not limited thereto. The linear compressor can be widely used in the whole industry.

Referring to FIG. 2, the compressor 100 may include a casing 110 and a main body received in the casing 110. The main body of the compressor 100 may include a frame 120, the cylinder 140 fixed to the frame 120, the piston 150 that linearly reciprocates inside the cylinder 140, the drive unit 130 that is fixed to the frame 120 and gives a driving force to the piston 150, and the like. Here, the cylinder 140 and the piston 150 may be referred to as compression units 140 and 150.

The compressor 100 may include a bearing means for reducing a friction between the cylinder 140 and the piston 150. The bearing means may be an oil bearing or a gas bearing. Alternatively, a mechanical bearing may be used as the bearing means.

The main body of the compressor 100 may be elastically supported by support springs 116 and 117 installed at both ends in the casing 110. The support springs 116 and 117 may include a first support spring 116 for supporting the rear of the main body and a second support spring 117 for supporting a front of the main body. The support springs 116 and 117 may include a leaf spring. The support springs 116 and 117 can absorb vibrations and impacts generated by a reciprocating motion of the piston 150 while supporting the internal parts of the main body of the compressor 100.

The casing 110 may define a sealed space. The sealed space may include a receiving space 101 in which the sucked refrigerant is received, an intake space 102 which is filled with the refrigerant before the compression, a compression space 103 in which the refrigerant is compressed, and a discharge space 104 which is filled with the compressed refrigerant.

The refrigerant sucked from the intake pipe 114 connected to the rear side of the casing 110 may be filled in the receiving space 101, and the refrigerant in the intake space 102 communicating with the receiving space 101 may be compressed in the compression space 103, discharged into the discharge space 104, and discharged to the outside through the discharge pipe 115 connected to the front side of the casing 110.

The casing 110 may include the shell 111 formed in a substantially cylindrical shape that is open at both ends and is long in a transverse direction, the first shell cover 112 coupled to the rear side of the shell 111, and the second shell cover 113 coupled to the front side of the shell 111. Here, it can be understood that the front side is the left side of the figure and is a direction in which the compressed refrigerant is discharged, and the rear side is the right side of the figure and is a direction in which the refrigerant is introduced. Further, the first shell cover 112 and the second shell cover 113 may be formed as one body with the shell 11.

The casing 110 may be formed of a thermally conductive material. Hence, heat generated in the inner space of the casing 110 can be quickly dissipated to the outside.

The first shell cover 112 may be coupled to the shell 111 in order to seal the rear of the shell 111, and the intake pipe 114 may be inserted and coupled to the center of the first shell cover 112.

The rear of the main body of the compressor 100 may be elastically supported by the first support spring 116 in the radial direction of the first shell cover 112.

The first support spring 116 may include a circular leaf spring. An edge of the first support spring 116 may be elastically supported by a support bracket 123*a* in a forward direction with respect to a back cover 123. An opened center portion of the first support spring 116 may be supported by an intake guide 116*a* in a rearward direction with respect to the first shell cover 112.

The intake guide 116*a* may have a through passage formed therein. The intake guide 116*a* may be formed in a cylindrical shape. A front outer circumferential surface of the intake guide 116*a* may be coupled to a central opening of the first support spring 116, and a rear end of the intake guide 116*a* may be supported by the first shell cover 112. In this instance, a separate intake support member 116*b* may be interposed between the intake guide 116*a* and an inner surface of the first shell cover 112.

A rear side of the intake guide 116*a* may communicate with the intake pipe 114, and the refrigerant sucked through the intake pipe 114 may pass through the intake guide 116*a* and may be smoothly introduced into a muffler unit 160 to be described below.

A damping member 116*c* may be disposed between the intake guide 116*a* and the intake support member 116*b*. The damping member 116*c* may be formed of a rubber material or the like. Hence, a vibration that may occur in the process of sucking the refrigerant through the intake pipe 114 can be prevented from being transmitted to the first shell cover 112.

The second shell cover 113 may be coupled to the shell 111 to seal the front side of the shell 111, and the discharge pipe 115 may be inserted and coupled through a loop pipe 115*a*. The refrigerant discharged from the compression space 103 may pass through a discharge cover assembly 180 and then may be discharged into the refrigeration cycle through the loop pipe 115*a* and the discharge pipe 115.

A front side of the main body of the compressor 100 may be elastically supported by the second support spring 117 in the radial direction of the shell 111 or the second shell cover 113.

The second support spring 117 may include a circular leaf spring. An opened center portion of the second support spring 117 may be supported by a first support guide 117*b* in a rearward direction with respect to the discharge cover assembly 180. An edge of the second support spring 117 may be supported by a support bracket 117*a* in a forward direction with respect to the inner surface of the shell 111 or the inner circumferential surface of the shell 111 adjacent to the second shell cover 113.

Unlike FIG. 2, the edge of the second support spring 117 may be supported in the forward direction with respect to the inner surface of the shell 111 or the inner circumferential surface of the shell 111 adjacent to the second shell cover 113 through a separate bracket (not shown) coupled to the second shell cover 113.

The first support guide 117*b* may be formed in a cylindrical shape. A cross section of the first support guide 117*b* may have a plurality of diameters. A front side of the first support guide 117*b* may be inserted into a central opening of the second support spring 117, and a rear side of the first support guide 117*b* may be connected to the discharge cover assembly 180. A support cover 117*c* may be coupled to the front side of the first support guide 117*b* with the second support spring 117 interposed therebetween. A cup-shaped second support guide 117*d* that is recessed forward may be coupled to the front side of the support cover 117*c*. A cup-shaped third support guide 117*e* that corresponds to the second support guide 117*d* and is recessed rearward may be coupled to the inside of the second shell cover 113. The second support guide 117*d* may be inserted into the third support guide 117*e* and may be supported in the axial direction and/or the radial direction. In this instance, a gap may be formed between the second support guide 117*d* and the third support guide 117*e*.

The frame 120 may include a body portion 121 supporting the outer circumferential surface of the cylinder 140, and a first flange portion 122 that is connected to one side of the body portion 121 and supports the drive unit 130. The frame 120 may be elastically supported with respect to the casing 110 by the first and second support springs 116 and 117 together with the drive unit 130 and the cylinder 140.

The body portion 121 may wrap the outer circumferential surface of the cylinder 140. The body portion 121 may be formed in a cylindrical shape. The first flange portion 122 may extend from a front end of the body portion 121 in the radial direction.

The cylinder 140 may be coupled to an inner circumferential surface of the body portion 121. An inner stator 134 may be coupled to an outer circumferential surface of the body portion 121. For example, the cylinder 140 may be pressed and fitted to the inner circumferential surface of the body portion 121, and the inner stator 134 may be fixed using a separate fixing ring (not shown).

An outer stator 131 may be coupled to a rear surface of the first flange portion 122, and the discharge cover assembly 180 may be coupled to a front surface of the first flange portion 122. For example, the outer stator 131 and the discharge cover assembly 180 may be fixed through a mechanical coupling means.

On one side of the front surface of the first flange portion 122, a bearing inlet groove 125*a* forming a part of the gas bearing may be formed, a first bearing communication hole 125*b* penetrating from the bearing inlet groove 125*a* to the inner circumferential surface of the body portion 121 may be formed, and a gas groove 125*c* communicating with the first bearing communication hole 125*b* may be formed on the inner circumferential surface of the body portion 121.

The bearing inlet groove 125*a* may be recessed to a predetermined depth in the axial direction. The first bearing communication hole 125*b* is a hole having a smaller cross-sectional area than the bearing inlet groove 125*a* and may be inclined toward the inner circumferential surface or the inner surface of the body portion 121. The gas groove 125*c* may be formed in an annular shape having a predetermined depth and an axial length on the inner circumferential surface of the body portion 121. Alternatively, the gas groove 125*c* may be formed on the outer circumferential surface of the cylinder 140 in contact with the inner circumferential surface of the body portion 121, or formed on both the inner circumferential surface of the body portion 121 and the outer circumferential surface of the cylinder 140.

In addition, a gas inlet 142 corresponding to the gas groove 125*c* may be formed on the outer circumferential surface of the cylinder 140. The gas inlet 142 forms a kind of nozzle in the gas bearing.

The frame 120 and the cylinder 140 may be formed of aluminum or an aluminum alloy material.

The cylinder 140 may be formed in a cylindrical shape in which both ends are opened. The piston 150 may be inserted through a rear end of the cylinder 140. A front end of the cylinder 140 may be closed via a discharge valve assembly 170. The compression space 103 may be formed between the cylinder 140, a front end of the piston 150, and the discharge valve assembly 170. Here, the front end of the piston 150 may be referred to as a head portion 151. The volume of the compression space 103 increases when the piston 150 moves backward, and decreases as the piston 150 moves forward. That is, the refrigerant introduced into the compression space 103 may be compressed while the piston 150 moves forward, and may be discharged through the discharge valve assembly 170.

The cylinder 140 may include a second flange portion 141 disposed at the front end. The second flange portion 141 may bend to the outside of the cylinder 140. The second flange portion 141 may extend in an outer circumferential direction of the cylinder 140. The second flange portion 141 of the cylinder 140 may be coupled to the frame 120. For example, the front end of the frame 120 may include a flange groove corresponding to the second flange portion 141 of the cylinder 140, and the second flange portion 141 of the cylinder 140 may be inserted into the flange groove and coupled to the flange groove through a coupling member. An O-ring 124 may be formed between the frame 120 and the second flange portion 141 of the cylinder 140. The O-ring 124 seals a space between the frame 120 and the second flange portion 141 of the cylinder 140, and can prevent the refrigerant from leaking forward through the frame 120 of the gas bearing and the second flange portion 141 of the cylinder 140. The O-ring 124 may include a first O-ring 124*a* disposed behind the second flange portion 141 of the cylinder 140 and a second O-ring 124*b* disposed forward relative to the second flange portion 141.

A gas bearing means may be provided to supply a discharge gas to a space between the outer circumferential surface of the piston 150 and the inner circumferential surface of the cylinder 140 and lubricate between the cylinder 140 and the piston 150 with gas. The discharge gas supplied between the cylinder 140 and the piston 150 may provide a levitation force to the piston 150 to reduce a friction generated between the piston 150 and the cylinder 140.

For example, the cylinder 140 may include the gas inlet 142. The gas inlet 142 may communicate with the gas groove 125*c* formed on the inner circumferential surface of the body portion 121. The gas inlet 142 may pass through the cylinder 140 in the radial direction. The gas inlet 142 may guide the compressed refrigerant introduced in the gas groove 125*c* between the inner circumferential surface of the cylinder 140 and the outer circumferential surface of the piston 150. Alternatively, the gas groove 125*c* may be formed on the outer circumferential surface of the cylinder 140 in consideration of the convenience of processing.

An entrance of the gas inlet 142 may be formed relatively widely, and an exit of the gas inlet 142 may be formed as a fine through hole to serve as a nozzle. The entrance of the gas inlet 142 may further include a filter (not shown) blocking the inflow of foreign matter. The filter may be a metal mesh filter, or may be formed by winding a member such as fine thread.

The plurality of gas inlets 142 may be independently formed. Alternatively, the entrance of the gas inlet 142 may be formed as an annular groove, and a plurality of exits may be formed along the annular groove at regular intervals. The gas inlet 142 may be formed only at the front side based on the axial direction center of the cylinder 140. On the contrary, the gas inlet 142 may be formed at the rear side based on the axial direction center of the cylinder 140 in consideration of the sagging of the piston 150.

The piston 150 is inserted into the opened rear end of the cylinder 140 and is provided to seal the rear of the compression space 103.

The piston 150 may include a head portion 151 and a guide portion 152. The head portion 151 may be formed in a disc shape. The head portion 151 may be partially open. The head portion 151 may partition the compression space 103. The guide portion 152 may extend rearward from an outer circumferential surface of the head portion 151. The guide portion 152 may be formed in a cylindrical shape. The inside of the guide portion 152 may be empty, and a front of the guide portion 152 may be partially sealed by the head portion 151. A rear of the guide portion 152 may be opened and connected to the muffler unit 160. The head portion 151 may be provided as a separate member coupled to the guide portion 152. Alternatively, the head portion 151 and the guide portion 152 may be formed as one body.

The piston 150 may include an intake port 154. The intake port 154 may pass through the head portion 151. The intake port 154 may communicate with the intake space 102 and the compression space 103 inside the piston 150. For example, the refrigerant flowing from the receiving space 101 to the intake space 102 in the piston 150 may pass through the intake port 154 and may be sucked into the compression space 103 between the piston 150 and the cylinder 140.

The intake port 154 may extend in the axial direction of the piston 150. The intake port 154 may be inclined in the axial direction of the piston 150. For example, the intake port 154 may extend to be inclined in a direction away from the central axis as it goes to the rear of the piston 150.

A cross section of the intake port 154 may be formed in a circular shape. The intake port 154 may have a constant inner diameter. In contrast, the intake port 154 may be formed as a long hole in which an opening extends in the radial direction of the head portion 151, or may be formed such that the inner diameter becomes larger as it goes to the rear.

The plurality of intake ports 154 may be formed in at least one of the radial direction and the circumferential direction of the head portion 151.

The head portion 151 of the piston 150 adjacent to the compression space 103 may be equipped with an intake valve 155 for selectively opening and closing the intake port 154. The intake valve 155 may operate by elastic deformation to open or close the intake port 154. That is, the intake valve 155 may be elastically deformed so that the intake port 154 is opened by the pressure of the refrigerant that passes through the intake port 154 and flows into the compression space 103. The intake valve 155 may be a lead valve, but is not limited thereto and can be variously changed.

The piston 150 may be connected to a mover 135. The mover 135 may reciprocate forward and backward according to the movement of the piston 150. The inner stator 134 and the cylinder 140 may be disposed between the mover 135 and the piston 150. The mover 135 and the piston 150 may be connected to each other by a magnet frame 136 that is formed by detouring the cylinder 140 and the inner stator 134 to the rear.

The muffler unit 160 may be coupled to the rear of the piston 150 to reduce a noise generated in the process of sucking the refrigerant into the piston 150. The refrigerant sucked through the intake pipe 114 may flow into the intake space 102 in the piston 150 via the muffler unit 160.

The muffler unit 160 may include an intake muffler 161 communicating with the receiving space 101 of the casing 110, and an inner guide 162 that is connected to a front of the intake muffler 161 and guides the refrigerant to the intake port 154.

The intake muffler 161 may be positioned behind the piston 150. A rear opening of the intake muffler 161 may be disposed adjacent to the intake pipe 114, and a front end of the intake muffler 161 may be coupled to the rear of the piston 150. The intake muffler 161 may have a flow path formed in the axial direction to guide the refrigerant in the receiving space 101 to the intake space 102 inside the piston 150.

The inside of the intake muffler 161 may include a plurality of noise spaces partitioned by a baffle. The intake muffler 161 may be formed by combining two or more members. For example, a second intake muffler may be press-coupled to the inside of a first intake muffler to define a plurality of noise spaces. In addition, the intake muffler 161 may be formed of a plastic material in consideration of weight or insulation property.

One side of the inner guide 162 may communicate with the noise space of the intake muffler 161, and other side may be deeply inserted into the piston 150. The inner guide 162 may be formed in a pipe shape. Both ends of the inner guide 162 may have the same inner diameter. The inner guide 162 may be formed in a cylindrical shape. Alternatively, an inner diameter of a front end that is a discharge side of the inner guide 162 may be greater than an inner diameter of a rear end opposite the front end.

The intake muffler 161 and the inner guide 162 may be provided in various shapes and may adjust the pressure of the refrigerant passing through the muffler unit 160. The intake muffler 161 and the inner guide 162 may be formed as one body.

The discharge valve assembly 170 may include a discharge valve 171, a valve spring 172 that is provided on a front side of the discharge valve 171 to elastically support the discharge valve 171, and a spring support member 173 that is coupled to the discharge cover assembly 180 and supports the valve spring 172. The discharge valve assembly 170 may selectively discharge the compressed refrigerant in the compression space 103. Here, the compression space 103 means a space between the intake valve 155 and the discharge valve 171.

The discharge valve 171 may be disposed to be supportable on the front surface of the cylinder 140. The discharge valve 171 may selectively open and close the front opening of the cylinder 140. The discharge valve 171 may operate by elastic deformation to open or close the compression space 103. The discharge valve 171 may be elastically deformed to open the compression space 103 by the pressure of the refrigerant flowing into the discharge space 104 through the compression space 103. For example, the compression space 103 may maintain a sealed state while the discharge valve 171 is supported on the front surface of the cylinder 140, and the compressed refrigerant of the compression space 103 may be discharged into an opened space in a state where the discharge valve 171 is spaced apart from the front surface of the cylinder 140. The discharge valve 171 may be a lead valve, but is not limited thereto.

The valve spring 172 may be provided between the discharge valve 171 and the discharge cover assembly 180 to provide an elastic force in the axial direction. The valve spring 172 may be provided as a compression coil spring, or may be provided as a leaf spring in consideration of an occupied space or reliability.

When the pressure of the compression space 103 is equal to or greater than a discharge pressure, the valve spring 172 may open the discharge valve 171 while deforming forward, and the refrigerant may be discharged from the compression space 103 and discharged into a first discharge space **104*a* of the discharge cover assembly 180. When the discharge of the refrigerant is completed, the valve spring 172 provides a restoring force to the discharge valve 171 and thus can allow the discharge valve 171** to be closed.

A process of introducing the refrigerant into the compression space 103 through the intake valve 155 and discharging the refrigerant of the compression space 103 into the discharge space 104 through the discharge valve 171 is described as follows.

In the process in which the piston 150 linearly reciprocates in the cylinder 140, when the pressure of the compression space 103 is equal to or less than a predetermined intake pressure, the intake valve 155 is opened and thus the refrigerant is sucked into a compression space 103. On the other hand, when the pressure of the compression space 103 exceeds the predetermined intake pressure, the refrigerant of the compression space 103 is compressed in a state in which the intake valve 155 is closed.

When the pressure of the compression space 103 is equal to or greater than the predetermined intake pressure, the valve spring 172 deforms forward and opens the discharge valve 171 connected to the valve spring 172, and the refrigerant is discharged from the compression space 103 to the discharge space 104 of the discharge cover assembly 180. When the discharge of the refrigerant is completed, the valve spring 172 provides a restoring force to the discharge valve 171 and allows the discharge valve 171 to be closed, thereby sealing a front of the compression space 103.

The drive unit 130 may include the outer stator 131 that is disposed between the shell 111 and the frame 120 and surrounds the body portion 121 of the frame 120, the inner stator 134 that is disposed between the outer stator 131 and the cylinder 140 and surrounds the cylinder 140, and the mover 135 disposed between the outer stator 131 and the inner stator 134.

The outer stator 131 may be coupled to the rear of the first flange portion 122 of the frame 120, and the inner stator 134 may be coupled to the outer circumferential surface of the body portion 121 of the frame 120. The inner stator 134 may be spaced apart from the inside of the outer stator 131, and the mover 135 may be disposed in a space between the outer stator 131 and the inner stator 134.

The outer stator 131 may be equipped with a winding coil, and the mover 135 may include a permanent magnet. The permanent magnet may be comprised of a single magnet with one pole or configured by combining a plurality of magnets with three poles.

The outer stator 131 may include a coil winding body 132 surrounding the axial direction in the circumferential direction, and a stator core 133 stacked while surrounding the coil winding body 132. The coil winding body 132 may include a hollow cylindrical bobbin 132*a* and a coil 132*b* wound in a circumferential direction of the bobbin 132*a*. A cross section of the coil 132*b* may be formed in a circular or polygonal shape and, for example, may have a hexagonal shape. In the stator core 133, a plurality of lamination sheets may be laminated radially, or a plurality of lamination blocks may be laminated along the circumferential direction.

The front side of the outer stator 131 may be supported by the first flange portion 122 of the frame 120, and the rear side thereof may be supported by a stator cover 137. For example, the stator cover 137 may be provided in a hollow disc shape, a front surface of the stator cover 137 may be supported by the outer stator 131, and a rear surface thereof may be supported by a resonant spring 118.

The inner stator 134 may be configured by stacking a plurality of laminations on the outer circumferential surface of the body portion 121 of the frame 120 in the circumferential direction.

One side of the mover 135 may be coupled to and supported by the magnet frame 136. The magnet frame 136 has a substantially cylindrical shape and may be disposed to be inserted into a space between the outer stator 131 and the inner stator 134. The magnet frame 136 may be coupled to the rear side of the piston 150 to move together with the piston 150.

As an example, a rear end of the magnet frame 136 is bent and extended inward in the radial direction to form a first coupling portion 136*a*, and the first coupling portion 136*a* may be coupled to a third flange portion 153 formed behind the piston 150. The first coupling portion 136*a* of the magnet frame 136 and the third flange portion 153 of the piston 150 may be coupled through a mechanical coupling member.

A fourth flange portion 161*a* at the front of the intake muffler 161 may be interposed between the third flange portion 153 of the piston 150 and the first coupling portion 136*a* of the magnet frame 136. Thus, the piston 150, the muffler unit 160, and the mover 135 can linearly reciprocate together in a combined state.

When a current is applied to the drive unit 130, a magnetic flux may be formed in the winding coil, and an electromagnetic force may occur by an interaction between the magnetic flux formed in the winding coil of the outer stator 131 and a magnetic flux formed by the permanent magnet of the mover 135 to move the mover 135. At the same time as the reciprocating movement of the mover 135 in the axial direction, the piston 150 connected to the magnet frame 136 may also reciprocate integrally with the mover 135 in the axial direction.

The drive unit 130 and the compression units 140 and 150 may be supported by the support springs 116 and 117 and the resonant spring 118 in the axial direction.

The resonant spring 118 amplifies the vibration implemented by the reciprocating motion of the mover 135 and the piston 150 and thus can achieve an effective compression of the refrigerant. More specifically, the resonant spring 118 may be adjusted to a frequency corresponding to a natural frequency of the piston 150 and may allow the piston 150 to perform a resonant motion. Further, the resonant spring 118 generates a stable movement of the piston 150 and thus can reduce the generation of vibration and noise.

The resonant spring 118 may be a coil spring extending in the axial direction. Both ends of the resonant spring 118 may be connected to a vibrating body and a fixed body, respectively. For example, one end of the resonant spring 118 may be connected to the magnet frame 136, and the other end may be connected to the back cover 123. Therefore, the resonant spring 118 may be elastically deformed between the vibrating body vibrating at one end and the fixed body fixed to the other end.

A natural frequency of the resonant spring 118 may be designed to match a resonant frequency of the mover 135 and the piston 150 during the operation of the compressor 100, thereby amplifying the reciprocating motion of the piston 150. However, because the back cover 123 provided as the fixing body is elastically supported by the first support spring 116 in the casing 110, the back cover 123 may not be strictly fixed.

The resonant spring 118 may include a first resonant spring 118*a* supported on the rear side and a second resonant spring 118*b* supported on the front side based on a spring supporter 119.

The spring supporter 119 may include a body portion 119*a* surrounding the intake muffler 161, a second coupling portion 119*b* that is bent from a front of the body portion 119*a* in the inward radial direction, and a support portion 119*c* that is bent from the rear of the body portion 119*a* in the outward radial direction.

A front surface of the second coupling portion 119*b* of the spring supporter 119 may be supported by the first coupling portion 136*a* of the magnet frame 136. An inner diameter of the second coupling portion 119*b* of the spring supporter 119 may cover an outer diameter of the intake muffler 161. For example, the second coupling portion 119*b* of the spring supporter 119, the first coupling portion 136*a* of the magnet frame 136, and the third flange portion 153 of the piston 150 may be sequentially disposed and then integrally coupled through a mechanical member. In this instance, the description that the fourth flange portion 161*a* of the intake muffler 161 can be interposed between the third flange portion 153 of the piston 150 and the first coupling portion 136*a* of the magnet frame 136, and they can be fixed together is the same as that described above.

The first resonant spring 118*a* may be disposed between a front surface of the back cover 123 and a rear surface of the spring supporter 119. The second resonant spring 118*b* may be disposed between a rear surface of the stator cover 137 and a front surface of the spring supporter 119.

A plurality of first and second resonant springs 118*a* and 118*b* may be disposed in the circumferential direction of the central axis. The first resonant springs 118*a* and the second resonant springs 118*b* may be disposed parallel to each other in the axial direction, or may be alternately disposed. The first and second resonant springs 118*a* and 118*b* may be disposed at regular intervals in the radial direction of the central axis. For example, three first resonant springs 118*a* and three second resonant springs 118*b* may be provided and may be disposed at intervals of 120 degrees in the radial direction of the central axis.

The compressor 100 may include a sealing member that can increase a coupling force between the frame 120 and the components around the frame 120. For example, the sealing member may be provided in a portion where the frame 120 and the inner stator 134 are coupled and may be inserted into an installation groove provided at an outer surface of the frame 120. The sealing member may have a ring shape.

An operation of the linear compressor 100 described above is as follows.

First, when a current is applied to the drive unit 130, a magnetic flux may be formed in the outer stator 131 by the current flowing in the coil 132*b*. The magnetic flux formed in the outer stator 131 may generate an electromagnetic force, and the mover 135 including the permanent magnet may linearly reciprocate by the generated electromagnetic force. The electromagnetic force may be alternately generated in a direction (forward direction) in which the piston 150 is directed toward a top dead center (TDC) during a compression stroke, and in a direction (rearward direction) in which the piston 150 is directed toward a bottom dead center (BDC) during an intake stroke. That is, the drive unit 130 may generate a thrust which is a force for pushing the mover 135 and the piston 150 in a moving direction.

The piston 150 linearly reciprocating inside the cylinder 140 may repeatedly increase or reduce the volume of the compression space 103.

When the piston 150 moves in a direction (rearward direction) of increasing the volume of the compression space 103, a pressure of the compression space 103 may decrease. Hence, the intake valve 155 mounted in front of the piston 150 is opened, and the refrigerant remaining in the intake space 102 may be sucked into the compression space 103 along the intake port 154. The intake stroke may be performed until the piston 150 is positioned in the bottom dead center by maximally increasing the volume of the compression space 103.

The piston 150 reaching the bottom dead center may perform the compression stroke while switching its motion direction and moving in a direction (forward direction) of reducing the volume of the compression space 103. As the pressure of the compression space 103 increases during the compression stroke, the sucked refrigerant may be compressed. When the pressure of the compression space 103 reaches a setting pressure, the discharge valve 171 is pushed out by the pressure of the compression space 103 and is opened from the cylinder 140, and the refrigerant can be discharged into the discharge space 104 through a separation space. The compression stroke can continue while the piston 150 moves to the top dead center at which the volume of the compression space 103 is minimized.

As the intake stroke and the compression stroke of the piston 150 are repeated, the refrigerant introduced into the receiving space 101 inside the compressor 100 through the intake pipe 114 may be introduced into the intake space 102 in the piston 150 by sequentially passing the intake guide 116*a*, the intake muffler 161, and the inner guide 162, and the refrigerant of the intake space 102 may be introduced into the compression space 103 in the cylinder 140 during the intake stroke of the piston 150. After the refrigerant of the compression space 103 is compressed and discharged into the discharge space 104 during the compression stroke of the piston 150, the refrigerant may be discharged to the outside of the compressor 100 via the loop pipe 115*a* and the discharge pipe 115.

Figure 3:
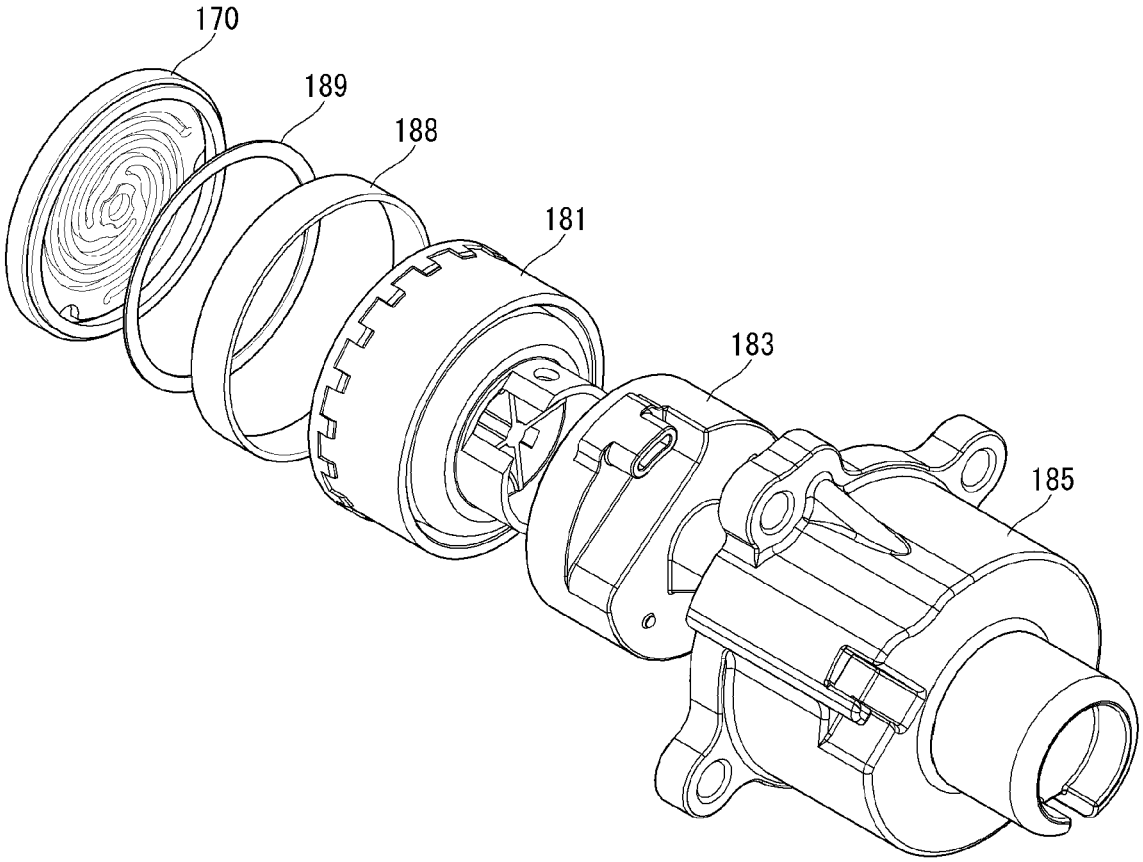
FIG. 3 is an exploded perspective view of a discharge cover assembly and a discharge valve assembly according to an embodiment of the present disclosure.
Figure 4:
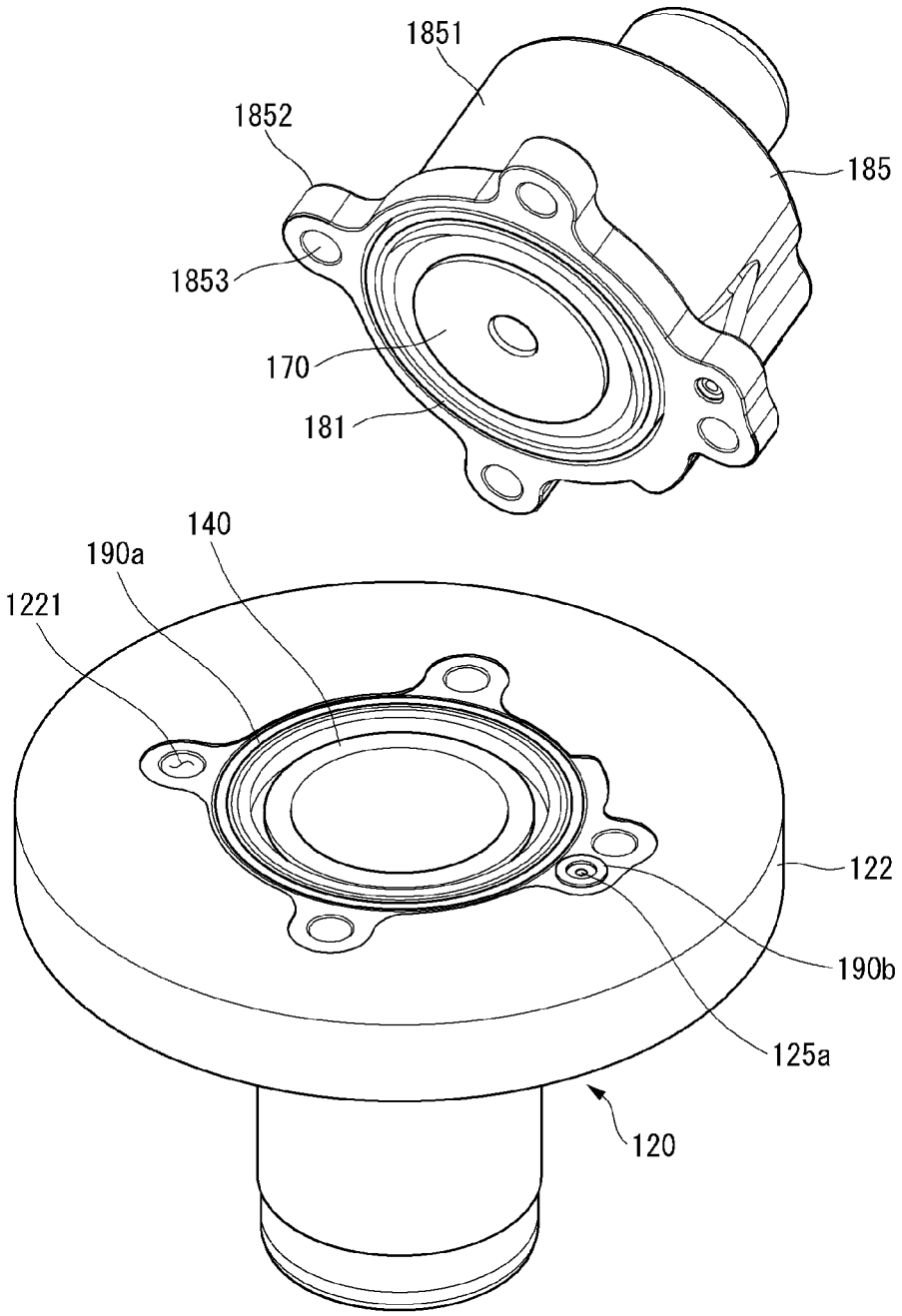
FIG. 4 is a perspective view illustrating that a discharge cover assembly and a discharge valve assembly are separated from a frame and a cylinder in accordance with an embodiment of the present disclosure.
Figure 5:
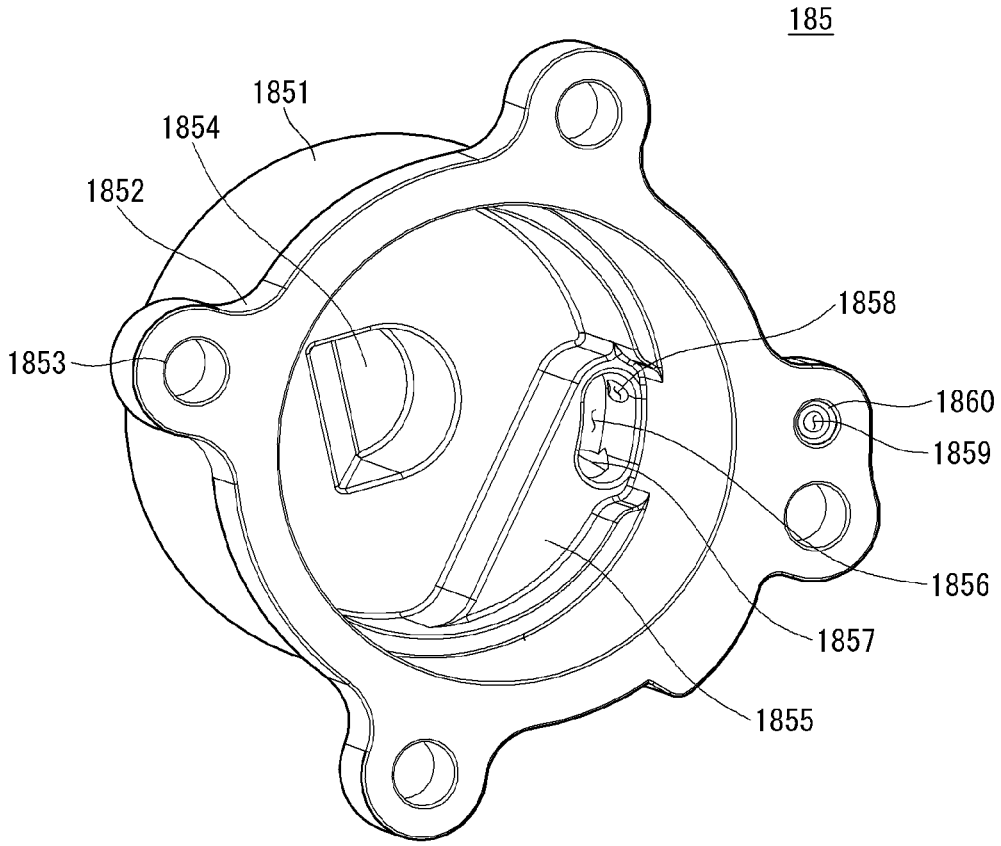
FIGS. 5 and 6 are perspective views of a discharge cover according to an embodiment of the present disclosure.
Figure 6:
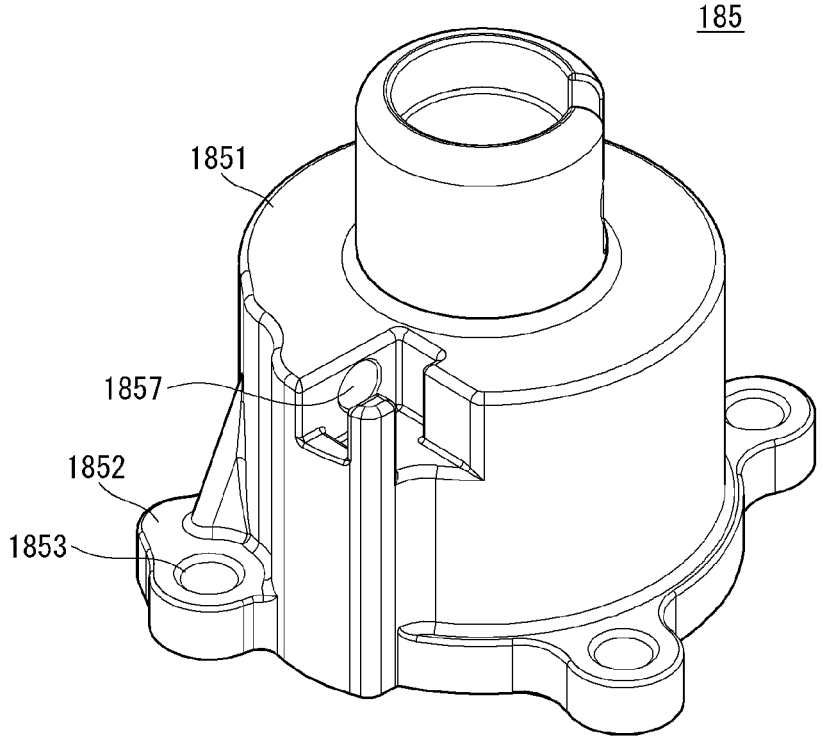
Figure 7:
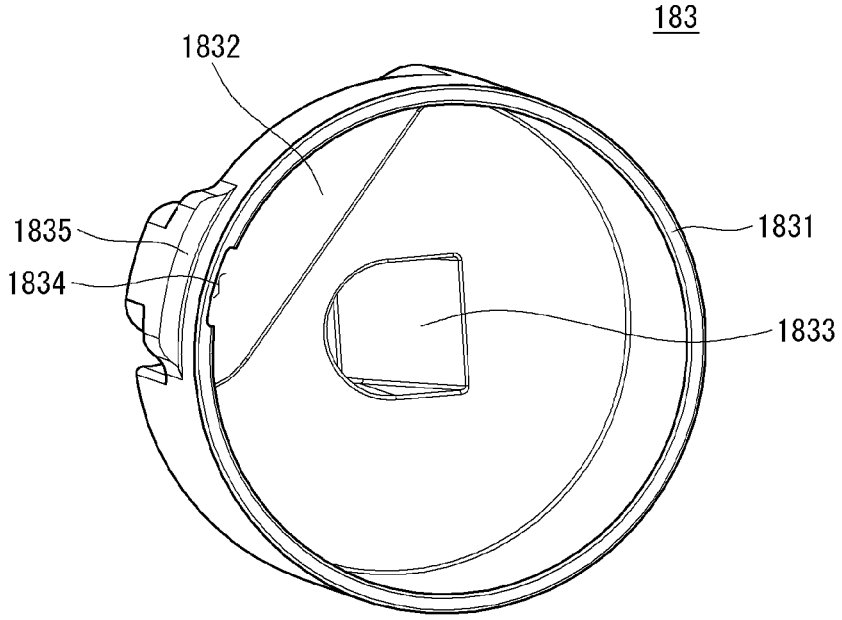
FIGS. 7 and 8 are perspective views of a second discharge plenum according to an embodiment of the present disclosure.
Figure 8:
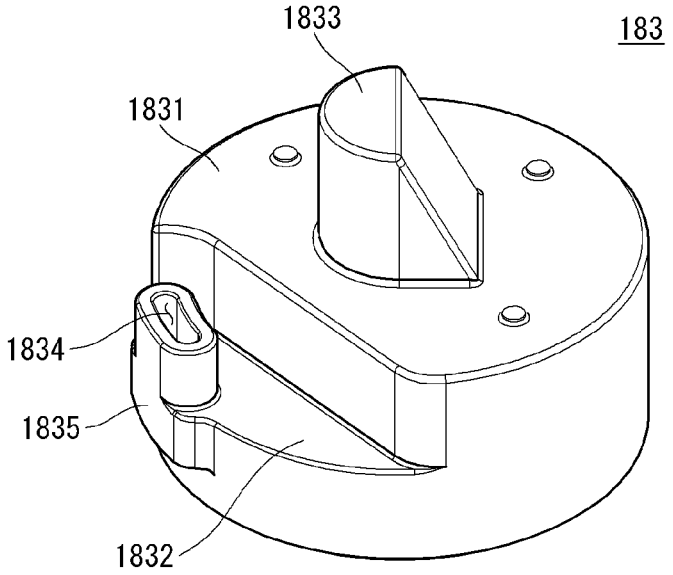
Figure 9:
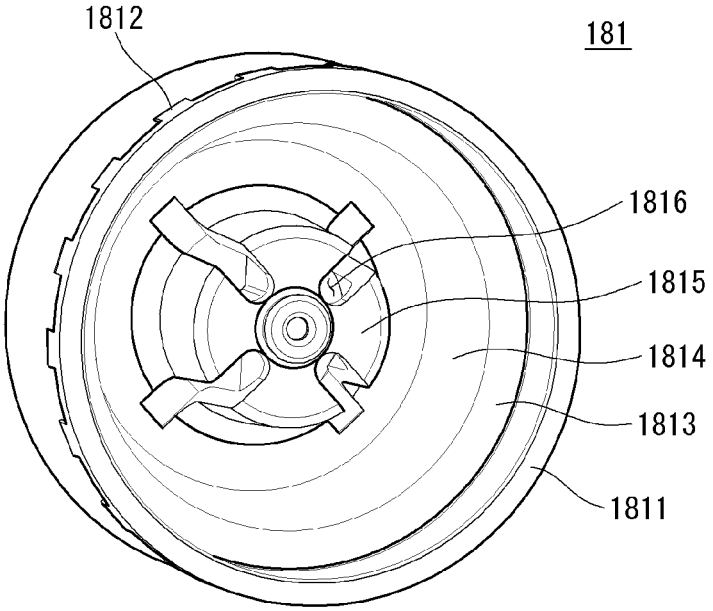
FIGS. 9 and 10 are perspective views of a first discharge plenum according to an embodiment of the present disclosure.
Figure 10:
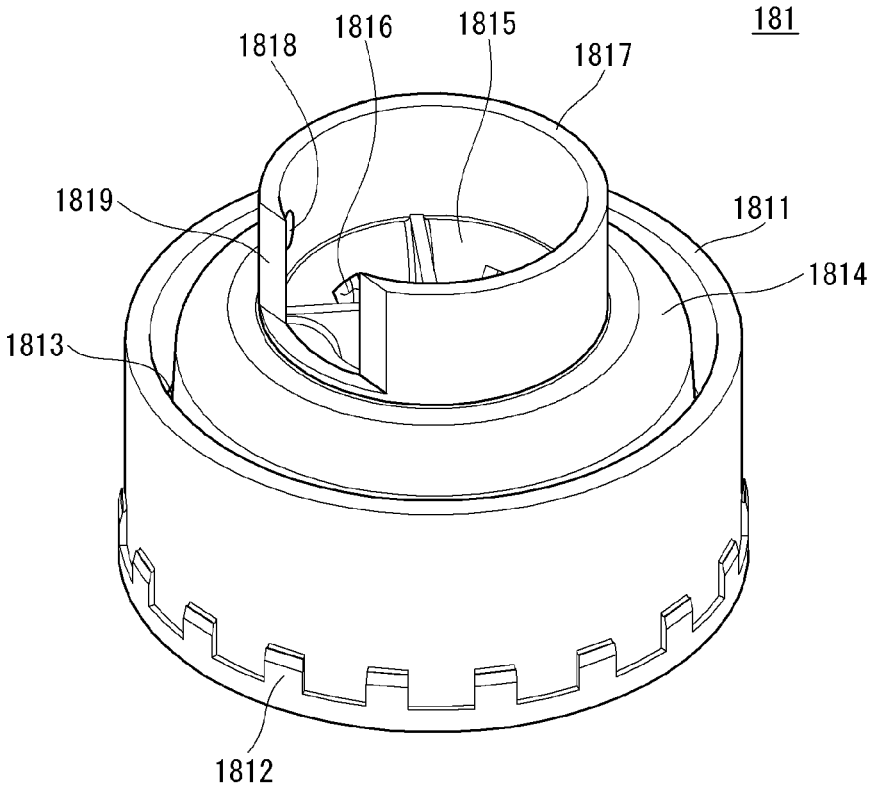
Figure 11:
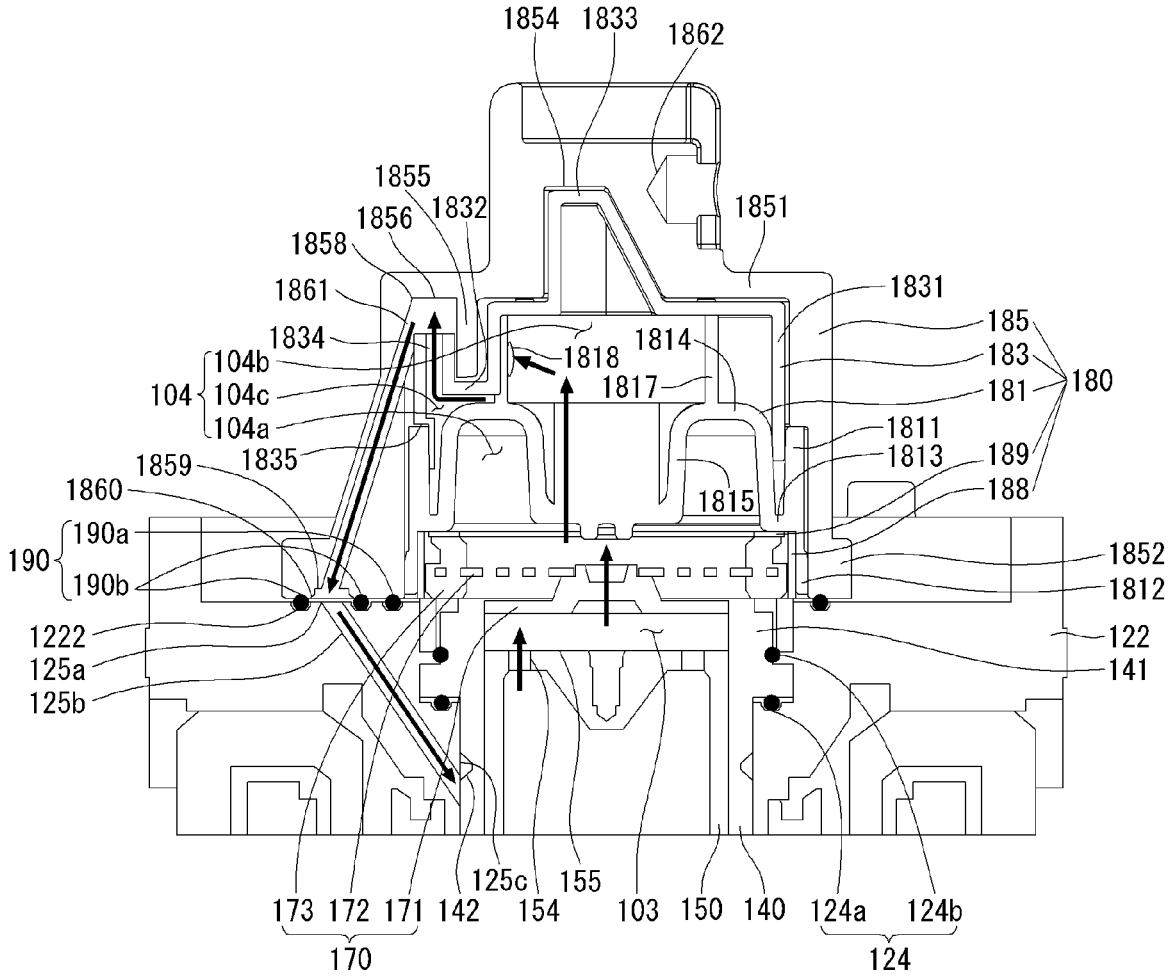
FIG. 11 is a perspective view of partial configuration of a linear compressor according to an embodiment of the present disclosure.
Figure 12:
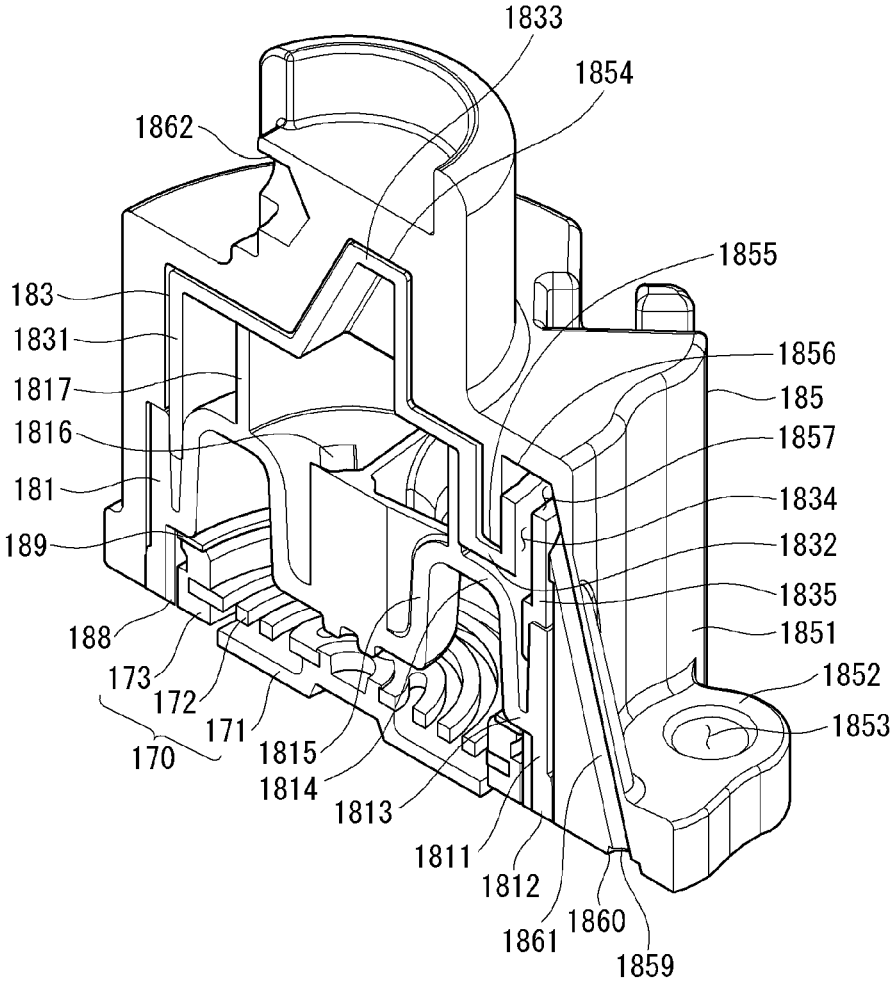
FIG. 12 is a perspective view illustrating that a part of a linear compressor according to an embodiment of the present disclosure is cut.
Figure 13:
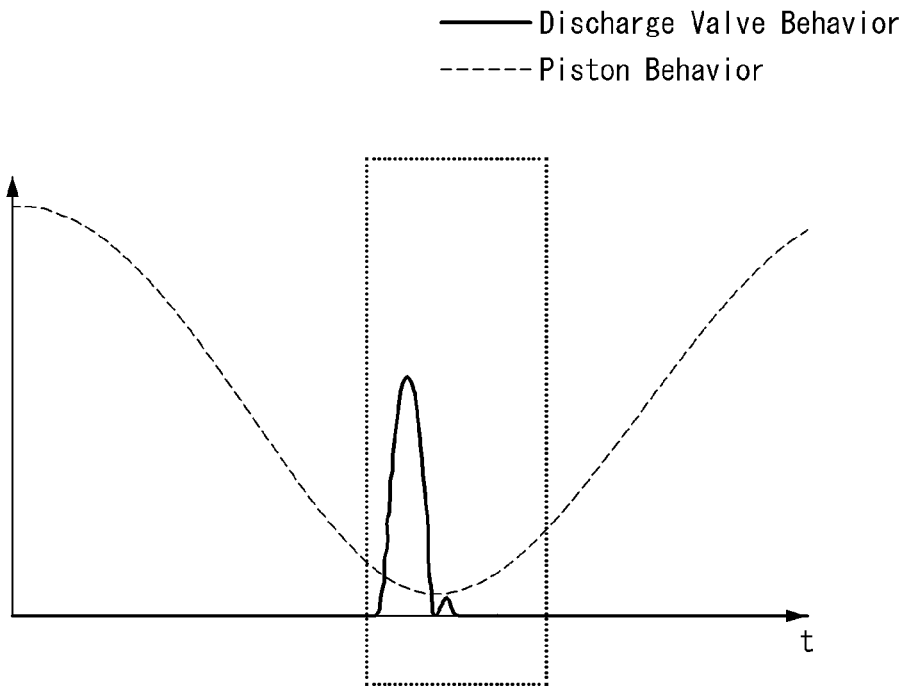
FIG. 13 is a graph illustrating behaviors of a piston and a discharge valve over time.
Figure 14:
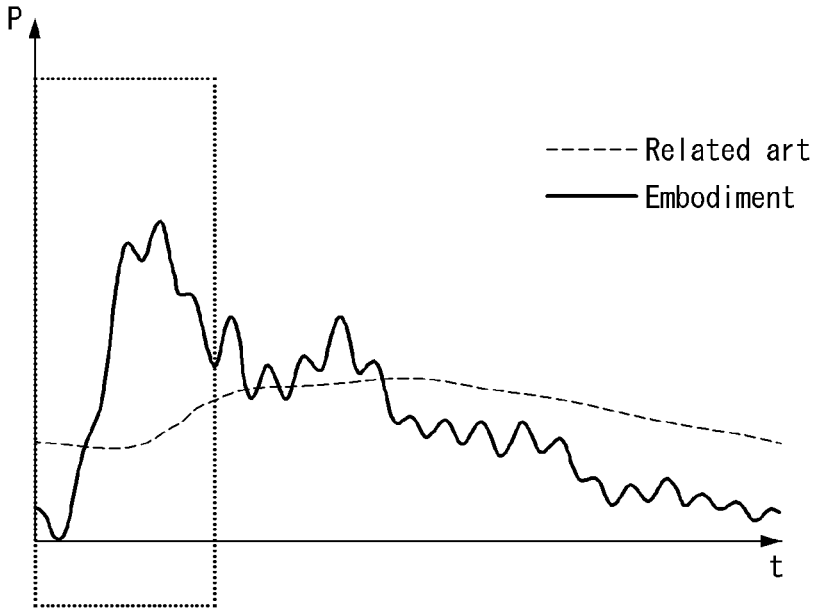
FIG. 14 is a graph illustrating a pressure distribution of a gas bearing over time.
Figure 15:
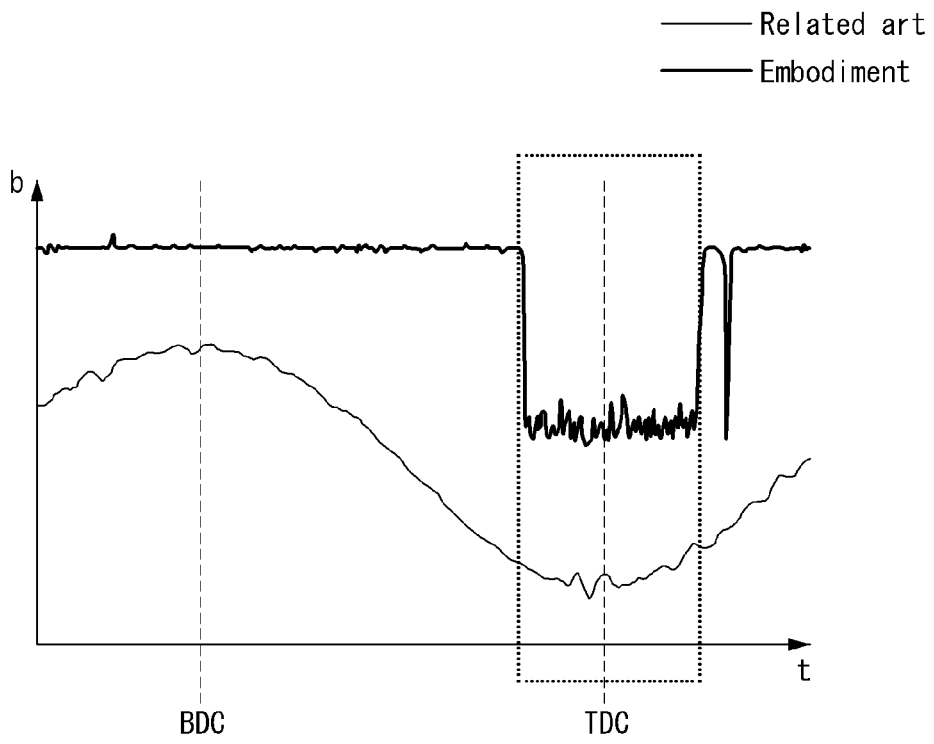
FIG. 15 is a graph illustrating a levitation force of a piston with respect to a cylinder over time.

FIG. 3 is an exploded perspective view of a discharge cover assembly and a discharge valve assembly according to an embodiment of the present disclosure. FIG. 4 is a perspective view illustrating that a discharge cover assembly and a discharge valve assembly are separated from a frame and a cylinder in accordance with an embodiment of the present disclosure. FIGS. 5 and 6 are perspective views of a discharge cover according to an embodiment of the present disclosure. FIGS. 7 and 8 are perspective views of a second discharge plenum according to an embodiment of the present disclosure. FIGS. 9 and 10 are perspective views of a first discharge plenum according to an embodiment of the present disclosure. FIG. 11 is a perspective view of partial configuration of a linear compressor according to an embodiment of the present disclosure. FIG. 12 is a perspective view illustrating that a part of a linear compressor according to an embodiment of the present disclosure is cut. FIG. 13 is a graph illustrating behaviors of a piston and a discharge valve over time. FIG. 14 is a graph illustrating a pressure distribution of a gas bearing over time. FIG. 15 is a graph illustrating a levitation force of a piston with respect to a cylinder over time.

Referring to FIGS. 3 to 12, in the linear compressor 100 according to an embodiment of the present disclosure, the discharge cover assembly 180 may include a discharge cover 185, a first discharge plenum 181, and a second discharge plenum 183, and the discharge valve assembly 170 may include a discharge valve 171, a valve spring 172, and a spring support member 173. However, embodiments of the present disclosure can be implemented based on fewer components and does not exclude additional components.

The discharge cover assembly 180 may be installed at the front of the compression space 103 to form the discharge space 104 receiving a refrigerant discharged from the compression space 103. In addition, the discharge cover assembly 180 may be coupled to the front of the frame 120 to reduce noise generated in the process of discharging the refrigerant from the compression space 103. The discharge cover assembly 180 may be coupled to the front of the first flange portion 122 of the frame 120. For example, the discharge cover assembly 180 may be coupled to the first flange portion 122 through a mechanical coupling member. The discharge cover assembly 180 may accommodate the discharge valve assembly 170. For example, the spring support member 173 of the discharge valve assembly 170 may be coupled to an inner rear portion of the first discharge plenum 181 of the discharge cover assembly 180.

The discharge cover assembly 180 may include the discharge cover 185. The discharge cover 185 may have a shape with an opened rear. The discharge cover 185 may be coupled to the frame 120. A rear surface of the discharge cover 185 may be coupled to the front surface of the first flange portion 122 of the frame 120. Specifically, a rear surface of a fifth flange portion 1852 extending radially at a rear end of a main body 1851 of the discharge cover 185 may be coupled to the front surface of the first flange portion 122 of the frame 120. In this case, as a mechanical coupling member such as a bolt is coupled to a first coupling hole 1853 formed in the fifth flange portion 1852 and a fixing groove 1221 of the first flange portion 122, the discharge cover 185 may be coupled to the front of the frame 120. A sealing member 190 may be disposed between the discharge cover 185 and the frame 120.

An inner space may be formed in a space between the inner surface of the discharge cover 185, the inner surface of the frame 120, and the piston 150. In the inner space of the discharge cover 185, the first discharge plenum 181, the second discharge plenum 183, the discharge valve assembly 170, a fixing ring 188, and a damper 189 may be disposed.

The discharge cover 185 may include a concave portion 1854 formed to be concave forward from an inner surface of the main body 1851. The concave portion 1854 may be formed in a central area of a bottom surface that forms the inner surface of the main body 1851. A convex portion 1833 of the second discharge plenum 183 may be disposed in the concave portion 1854. Through this, space efficiency in the discharge cover 185 can be improved.

The discharge cover 185 may include a stepped portion 1855 protruding rearward from the inner surface of the main body 1851. The stepped portion 1855 may be spaced apart from the central area of the bottom surface forming the inner surface of the main body 1851. The stepped portion 1855 may be connected to a sidewall portion forming the inner surface of the main body 1851. The stepped portion 1855 may be spaced apart from the concave portion 1854.

The discharge cover 185 may include a discharge groove 1856 formed to be concave forward from the stepped portion 1855. The discharge groove 1856 may be disposed adjacent to the sidewall portion forming the inner surface of the main body 1851. The discharge groove 1856 may include a first discharge hole 1857 through which the refrigerant flowing in a plurality of discharge spaces 104*a*, 104*b* and 104*c* is discharged to the outside of the discharge cover assembly 180, and a first bearing hole 1858 that allows the refrigerant flowing in the plurality of discharge spaces 104*a*, 104*b* and 104*c* to flow into the gas bearing. Through this, since the refrigerant immediately before being discharged to the outside of the discharge cover assembly 180 can flow into the gas bearing, the efficiency of the gas bearing can be improved.

The discharge cover 185 may include the first discharge hole 1857 that is formed in the discharge groove 1856 and communicates with the outside of the discharge cover 185. The first discharge hole 1857 may communicate with the loop pipe 115*a*. That is, the refrigerant flowing in the plurality of discharge spaces 104*a*, 104*b* and 104*c* may pass through the first discharge hole 1857 and the loop pipe 115*a* and may be discharged to the outside of the linear compressor 100 through the discharge pipe 115.

The discharge cover 185 may include a second bearing communication hole 1861 connecting the inner surface and the rear surface of the discharge cover 185. The second bearing communication hole 1861 may be formed in a side area of the main body 1851. The second bearing communication hole 1861 may communicate with the first bearing communication hole 125*b* connecting the front surface and the inner surface of the frame 120. The second bearing communication hole 1861 may face the first bearing communication hole 125*b*. The second bearing communication hole 1861 may communicate with the first discharge hole 1857 of the discharge cover 185 and a second discharge hole 1834 of the second discharge plenum 183. Through this, the refrigerant flowing in the plurality of discharge spaces 104*a*, 104*b* and 104*c* may be guided to the first bearing communication hole 125*b* before being discharged to the outside of the discharge cover assembly 180.

A diameter of the second bearing communication hole 1861 may correspond to a diameter of the first bearing communication hole 125*b*. Hence, embodiments of the present disclosure prevent compression and expansion that may occur in the process of supplying the refrigerant flowing in the discharge cover assembly 180 to the gas bearing, and thus can prevent a pressure drop in the gas bearing and improve the efficiency of the gas bearing.

The second bearing communication hole 1861 may have a predetermined angle with respect to the rear surface or the inner surface of the discharge cover 185. That is, since a cross section of the second bearing communication hole 1861 has a straight flow path, the flow path of the refrigerant passing through the second bearing communication hole 1861 can be minimized, thereby improving the efficiency of the gas bearing.

The discharge cover 185 may include the first bearing hole 1858 that is formed in the discharge groove 1856 and communicates with the second bearing communication hole 1861. The first bearing hole 1858 may correspond to the diameter of the second bearing communication hole 1861.

The discharge cover 185 may include a second bearing hole 1859 that is formed in the rear surface of the fifth flange portion 1852 and communicates with the second bearing communication hole 1861. A diameter of the second bearing hole 1859 may correspond to the diameter of the second bearing communication hole 1861. The second bearing hole 1859 may face the first bearing communication hole 125*b*, and the diameter of the second bearing hole 1859 may correspond to the diameter of the first bearing communication hole 125*b*.

The discharge cover 185 may include a first sealing groove 1860 that is formed in the rear surface of the fifth flange portion 1852 and is adjacent to the second bearing hole 1859. A first sealing member 190*b* may be disposed in the first sealing groove 1860. Through this, embodiments of the present disclosure can prevent the refrigerant flowing from the second bearing communication hole 1261 to the first bearing communication hole 125*b* from leaking into the space between the frame 120 and the discharge cover 185.

The discharge cover 185 may protrude to the front area of the main body 1851, and a support guide coupling portion 1862 to which the first support guide 117*b* is coupled may be formed.

The discharge cover 185 may be comprised of one discharge cover, or may be configured so that a plurality of discharge covers sequentially communicates with each other.

The discharge cover assembly 180 may include the first discharge plenum 181. The first discharge plenum 181 may be disposed in the discharge cover 185. The first discharge plenum 181 may partition the inner space of the discharge cover 185 into the plurality of discharge spaces 104*a*, 104*b* and 104*c*. The first discharge plenum 181 may be disposed in front of the discharge valve assembly 170. The first discharge plenum 181 may be disposed behind the second discharge plenum 183.

The first discharge plenum 181 may be in close contact with the inner surface of the discharge cover 185. Through this, embodiments of the present disclosure can prevent the refrigerant flowing in the first discharge plenum 181 from transferring heat to the refrigerant in the shell 111 through the discharge cover 185.

The first discharge plenum 181 may be formed of an aluminum material. Through this, heat of the refrigerant flowing in the first discharge plenum 181 can be prevented from being transferred to the discharge cover 185 through the first discharge plenum 181.

The first discharge plenum 181 may include a first contact member 1811 that is in close contact with the inner surface of the discharge cover 185. The first contact member 1811 may be in close contact with a rear area of a side wall portion forming the inner surface of the discharge cover 185. The first contact member 1811 may be formed in a hollow cylindrical shape. An outer diameter of the first contact member 1811 may correspond to an inner diameter of the discharge cover 185. Through this, the refrigerant flowing in the first discharge plenum 181 can be prevented from directly contacting the inner surface of the discharge cover 185.

The first discharge plenum 181 may include a rib portion 1812 protruding outward from an outer circumferential surface or an outer surface of the first contact member 1811. The rib portion 1812 may be disposed in a rear area of the outer surface of the first contact member 1811. Through this, the rib portion 1812 can serve as a guide so that the first discharge plenum 181 is inserted into the discharge cover 185 from the rear of the discharge cover 185, and can also firmly press-fit the first discharge plenum 181 to the inner surface of the discharge cover 185. In addition, the rib portion 1812 can reduce a tolerance that may occur in the process of manufacturing and combining the first discharge plenum 181 and the discharge cover 185.

The first discharge plenum 181 includes a first partition 1814, a second partition 1815, and a third partition 1817 that partition the inner space of the discharge cover 185 into the plurality of discharge spaces 104*a*, 104*b* and 104*c*. An embodiment of the present disclosure has described that the number of partitions of the first discharge plenum 181 is three, by way of example, but is not limited thereto and can be variously changed.

The first partition 1814 may extend inward from the first contact member 1811. The first partition 1814 may have a shape that is convex outward or concave inward. The first partition 1814 may have a curvature. A rear end of the first partition 1814 may be disposed at a front surface of the spring support member 173. The first partition 1814 may be connected to the second partition 1815.

The second partition 1815 may extend inward from the first partition 1814. The second partition 1815 may have a shape that is concave outward or convex inward. The first partition 1814 and the second partition 1815 may form the first discharge space 104*a*. The first discharge space 104*a* may provide a space in which the refrigerant, that is compressed in the compression space 103 and passes through the discharge valve 171, flows. At least one first partition hole 1816 may be formed in the second partition 1815. The first partition hole 1816 may allow the first discharge space 104*a* and the second discharge space 104*b* to communicate with each other. Hence, the refrigerant in the first discharge space 104*a* may flow into the second discharge space 104*b*.

The third partition 1817 may protrude forward from a front area of the first partition 1814 or a front area of the second partition 1815. The second discharge space 104*b* may be formed between the third partition 1817 and the inner surface of the discharge cover 185. The second discharge space 104*b* may provide a space in which the refrigerant passing through the first discharge space 104*a* flows. A second partition hole 1818 may be formed in the third partition 1817. The second partition hole 1818 may allow the second discharge space 104*b* and the third discharge space 104*c* to communicate with each other. Hence, the refrigerant in the second discharge space 104*b* may flow into the third discharge space 104*c*.

In this case, the second partition hole 1818 may include one partition hole disposed adjacent to the discharge groove 1856 of the discharge cover 185. Hence, the flow efficiency in which the refrigerant in the second discharge space 104*b* flows into the third discharge space 104*c* may be improved.

The first discharge space 104*a* may selectively communicate with the compression space 103 by the discharge valve 171, the second discharge space 104*b* may communicate with the first discharge space 104*a*, and the third The discharge space 104*c* may communicate with the second discharge space 104*b*. Hence, the refrigerant discharged from the compression space 103 may sequentially passes through the first discharge space 104*a*, the second discharge space 104*b*, and the third discharge space 104*c* to reduce a discharge noise, and may be discharged to the outside of the casing 110 through the loop pipe 115*a* communicating with the discharge cover 185 and the discharge pipe 115.

The third partition 1817 may include a cut portion 1819. The cut portion 1819 may contact a protrusion 1832 of the second discharge plenum 183. Hence, embodiments of the present disclosure can prevent an operator's mistake that may occur when the first discharge plenum 181 and the second discharge plenum 183 are combined.

The first discharge plenum 181 may include a coupling groove 1813 formed to be concave rearward between the first contact member 1811 and the first partition 1814. A rear end of the second discharge plenum 183 may be disposed in the coupling groove 1813. The coupling groove 1813 may be coupled to a rear end of a second contact member 1831 of the second discharge plenum 183. Through this, embodiments of the present disclosure can reduce a space in which the refrigerant flowing between the first discharge plenum 181 and the second discharge plenum 183 directly contacts the inner surface of the discharge cover 185.

The discharge cover assembly 180 may include the second discharge plenum 183. The second discharge plenum 183 may be disposed in the discharge cover 185. The second discharge plenum 183 may be in close contact with the inner surface of the discharge cover 185. The second discharge plenum 183 may be disposed in front of the first discharge plenum 181. Through this, the refrigerant passing through the plurality of discharge spaces 104*a*, 104*b* and 104*c* can be prevented from directly contacting the inner surface of the discharge cover 185.

In addition, the second discharge plenum 183 may be formed of an aluminum material. Through this, heat of the refrigerant passing through the plurality of discharge spaces 104*a*, 104*b* and 104*c* can be prevented from being transferred to the discharge cover 185 through the second discharge plenum 183.

The second discharge plenum 183 may include the second contact member 1831 that is in close contact with the inner surface of the discharge cover 185. The second contact member 1831 may be disposed in front of the first contact member 1811 of the first discharge plenum 181. The rear end of the second contact member 1831 may be disposed in the coupling groove 1813 of the first discharge plenum 181. The second contact member 1831 may have a cylindrical shape with an open rear and a closed upper portion. The second contact member 1831 may be in close contact with the bottom and the side wall of the inner surface of the discharge cover 185. Through this, embodiments of the present disclosure prevent the refrigerant flowing in the plurality of discharge spaces 104*a*, 104*b* and 104*c* from directly contacting the discharge cover 185, and thus can prevent a reduction in refrigerant efficiency caused by a decrease in a temperature of the discharged refrigerant. In addition, embodiments of the present disclosure can improve the flow efficiency of the refrigerant provided to the gas bearing by preventing a decrease in the temperature of the discharged refrigerant.

The second discharge plenum 183 may include the convex portion 1833 that is formed to be convex forward from the second contact member 1831. The convex portion 1833 may be disposed in the concave portion 1854 of the discharge cover 185. The convex portion 1833 may be formed in a shape corresponding to the shape of the concave portion 1854 of the discharge cover 185. Through this, embodiments of the present disclosure can prevent the refrigerant flowing in the plurality of discharge spaces 104*a*, 104*b* and 104*c* from contacting the discharge cover 185 while improving space efficiency by increasing the area of the plurality of discharge spaces 104*a*, 104*b* and 104*c*.

The second discharge plenum 183 may include the protrusion 1832 protruding rearward from the second contact member 1831. The cut portion 1819 may be disposed on the side of the protrusion 1832. The third discharge space 104*c* may be formed between a rear surface of the protrusion 1832, the third partition 1817 of the first discharge plenum 181, and an upper surface of the first partition 1814.

The second discharge plenum 183 may include the second discharge hole 1834 formed between the second contact member 1831 and the protrusion 1832. The second discharge hole 1834 may communicate the third discharge space 104*c* with the discharge groove 1856. The second discharge hole 1834 may also communicate the third discharge space 104*c* with the first discharge hole 1857.

The second discharge plenum 183 may include a guide member 1835 that extends from the second contact member 1831 along the radial direction. The guide member 1835 may be disposed in front of the first contact member 1811. A rear surface of the guide member 1835 may be disposed on the front surface of the first contact member 1811. Through this, embodiments of the present disclosure can allow the second discharge plenum 183 to be in close contact with the inner surface of the discharge cover 185 while guiding a position of the second discharge plenum 183 with respect to the first discharge plenum 181.

An embodiment of the present disclosure has described that the first and second discharge plenums 181 and 183 are in close contact with the inner surface of the discharge cover 185, by way of example, but is not limited thereto. For example, the first and second discharge plenums 181 and 183 may not directly contact the inner surface of the discharge cover 185, and a gap may exist between the first and second discharge plenums 181 and 183 and the inner surface of the discharge cover 185. In this case, a stagnant thermal insulation layer without the flow may be formed in the gap between the first and second discharge plenums 181 and 183 and the inner surface of the discharge cover 185. Hence, heat transfer from the plurality of discharge spaces 104*a*, 104*b* and 104*c* to the discharge cover 185 can be prevented as much as possible.

The discharge cover assembly 180 may include the fixing ring 188. The fixing ring 188 may be disposed between the first discharge plenum 181 and the discharge valve assembly 170. More specifically, the fixing ring 188 may be disposed between the inner surface of the first contact member 1811 of the first discharge plenum 181 and the outer surface of the spring support member 173 of the discharge valve assembly 170. The fixing ring 188 may be formed in an annular shape. The fixing ring 188 may be formed in a ring shape. The fixing ring 188 may be press-fit between the spring support member 173 of the discharge valve assembly 170 and the first contact member 1811 of the first discharge plenum 181 and may firmly fix the discharge valve assembly 170 to the inside of the discharge cover assembly 180.

The discharge cover assembly 180 may include the damper 189. The damper 189 may be disposed between the first discharge plenum 181 and the discharge valve assembly 170. More specifically, the damper 189 may be disposed between a rear surface of the first partition 1814 of the first discharge plenum 181 and the front surface of the spring support member 173. The damper 189 may prevent an axial vibration of the discharge valve assembly 170 from affecting the discharge cover assembly 180 when the piston 150 reciprocates in the axial direction. Hence, noise that may occur between the discharge valve assembly 170 and the discharge cover assembly 180 can be reduced.

The linear compressor 100 may include the sealing member 190. The sealing member 190 may be disposed between the discharge cover assembly 180 and the frame 120. The sealing member 190 can prevent the refrigerant flowing in the discharge cover assembly 180 from leaking into the space between the discharge cover assembly 180 and the frame 120.

The sealing member 190 may include a first sealing member 190*b*. The first sealing member 190*b* may be disposed between the discharge cover 185 and the first flange portion 122 of the frame 120. The first sealing member 190*b* may be disposed between the first bearing communication hole 125*b* and the second bearing communication hole 1861. Through this, embodiments of the present disclosure can prevent the refrigerant passing from the second bearing communication hole 1861 to the first bearing communication hole 125*b* from leaking into the space between the discharge cover 185 and the frame 120. In addition, embodiments of the present disclosure can prevent expansion and compression of the refrigerant passing from the second bearing communication hole 1861 to the first bearing communication hole 125*b*. The first sealing member 190*b* may be formed in a circular ring shape.

The first sealing member 190*b* may be disposed in a second sealing groove 1222 formed on the front surface of the first flange portion 122 of the frame 120.

The sealing member 190 may include a second sealing member 190*a*. The second sealing member 190*a* may be disposed between the discharge cover 185 and the frame 120. The second sealing member 190*a* may be formed in a circular ring shape.

Through this, embodiments of the present disclosure can prevent the refrigerant flowing in the plurality of discharge spaces 104*a*, 104*b* and 104*c* from leaking into the space between the frame 120 and the discharge cover 185. In addition, embodiments of the present disclosure can prevent the refrigerant leaking into the space between the frame 120 and the discharge cover 185 from being mixed into the first bearing communication hole 125*b* and the second bearing communication hole 1861, and thus improve the efficiency of the gas bearing.

It can be seen from FIG. 13 that, at the top dead center (TDC), the piston 150 moves to the front, and the discharge valve 171 behaves by the refrigerant compressed in the compression space 103.

With reference to FIG. 14, a pressure distribution over time of the gas bearing is illustrated. According to an embodiment of the present disclosure, when the piston 150 is positioned around the top dead center, a pressure of the gas bearing can increase compared to the related art.

With reference to FIG. 15, a levitation force of the piston 150 over time is illustrated. According to an embodiment of the present disclosure, when the piston 150 is positioned around the top dead center, the levitation force of the piston 150 can increase compared to the related art.

In other words, embodiments of the present disclosure prevent the refrigerant flowing in the plurality of discharge spaces 104*a*, 104*b* and 104*c* from directly contacting the inner surface of the discharge cover 185, and thus can prevent a reduction in the efficiency of the refrigerant due to heat exchange between the refrigerant and the inside of the shell. In addition, embodiments of the present disclosure increase a supply pressure of the refrigerant, that is branched from the discharged refrigerant and is supplied to the gas bearing, since the temperature of the discharged refrigerant is not reduced compared to the existing one, and thus can improve the pressure of the gas bearing and the levitation force of the piston 150.

Furthermore, embodiments of the present disclosure can prevent a pressure drop of the refrigerant supplied to the gas bearing and prevent a loss of flow paths by preventing the refrigerant, that is branched from the discharged refrigerant and is supplied to the gas bearing, from repeating the expansion and contraction as much as possible. Hence, embodiments of the present disclosure can improve the pressure of the gas bearing and the levitation force of the piston 150 by increasing the supply pressure of the refrigerant supplied to the gas bearing.

Embodiments of the present disclosure can prevent heat transfer from the plurality of discharge spaces 104*a*, 104*b* and 104*c* to the discharge cover 185 as much as possible, by forming a stagnant thermal insulation layer without the flow in the gap between the inner surface of the discharge cover 185 and the plurality of discharge spaces 104*a*, 104*b* and 104*c*.

Some embodiments or other embodiments of the present disclosure described above are not exclusive or distinct from each other. Some embodiments or other embodiments of the present disclosure described above can be used together or combined in configuration or function.

For example, configuration "A" described in an embodiment and/or the drawings and configuration "B" described in another embodiment and/or the drawings can be combined with each other. That is, even if the combination between the configurations is not directly described, the combination is possible except in cases where it is described that it is impossible to combine.

The above detailed description is merely an example and is not to be considered as limiting the present disclosure. The scope of the present disclosure should be determined by rational interpretation of the appended claims, and all variations within the equivalent scope of the present disclosure are included in the scope of the present disclosure.

What is claimed is:

1. A linear compressor comprising:

a frame;

a cylinder disposed in the frame;

a piston disposed in the cylinder and configured to reciprocate relative to the cylinder in a forward direction and a rearward direction along an axis of the cylinder;

a discharge valve disposed forward relative to the piston; and a discharge cover assembly coupled to the frame and disposed forward relative to the piston, wherein the discharge cover assembly comprises:

a discharge cover that defines an inner space therein, a first discharge plenum that is disposed in the discharge cover and partitions the inner space of the discharge cover into a plurality of discharge spaces, and a second discharge plenum disposed forward relative to the first discharge plenum, the second discharge plenum being in close contact with an inner surface of the discharge cover, wherein the discharge cover defines a first discharge hole that is in fluid communication with the inner space of the discharge cover and an outside of the discharge cover, wherein the second discharge plenum defines a second discharge hole that is in fluid communication with the plurality of discharge spaces and the first discharge hole, and wherein the inner surface of the discharge cover is covered by the first discharge plenum and an area of the second discharge plenum outside the second discharge hole.

2. The linear compressor of claim 1, wherein the frame defines a first bearing communication hole that extends from a front surface of the frame to an inner surface of the frame, and wherein the discharge cover defines a second bearing communication hole that extends from the inner surface of the discharge cover to a rear surface of the discharge cover, the rear surface of the discharge cover facing the first bearing communication hole.

3. The linear compressor of claim 2, wherein the second bearing communication hole is in fluid communication with the first discharge hole and the second discharge hole.

4. The linear compressor of claim 2, wherein a diameter of the second bearing communication hole corresponds to a diameter of the first bearing communication hole.

5. The linear compressor of claim 2, further comprising a first sealing member disposed between the frame and the discharge cover and configured to block refrigerant passing through the first bearing communication hole from leaking into a space between the frame and the discharge cover.

6. The linear compressor of claim 2, wherein the second bearing communication hole extends along a direction inclined by a predetermined angle with respect to the rear surface of the discharge cover.

7. The linear compressor of claim 5, further comprising a second sealing member disposed between the frame and the discharge cover and configured to block leakage of the refrigerant from the plurality of discharge spaces into the space between the frame and the discharge cover.

8. A linear compressor comprising:

a frame;

a cylinder disposed in the frame;

a piston disposed in the cylinder and configured to reciprocate relative to the cylinder in a forward direction and a rearward direction along an axis of the cylinder;

a discharge valve disposed forward relative to the piston; and a discharge cover assembly coupled to the frame and disposed forward relative to the piston, wherein the discharge cover assembly comprises:

a discharge cover that defines an inner space therein, a first discharge plenum that is disposed in the discharge cover and partitions the inner space of the discharge cover into a plurality of discharge spaces, the first discharge plenum being in contact with an inner surface of the discharge cover, and a second discharge plenum disposed forward relative to the first discharge plenum, the second discharge plenum being in contact with the inner surface of the discharge cover, wherein the discharge cover defines a first discharge hole that is in fluid communication with the inner space of the discharge cover and an outside of the discharge cover, wherein the second discharge plenum defines a second discharge hole that is in fluid communication with the plurality of discharge spaces and the first discharge hole, and wherein the inner surface of the discharge cover is covered by the first discharge plenum and an area of the second discharge plenum outside the second discharge hole.

9. The linear compressor of claim 8, wherein the frame defines a first bearing communication hole that extends from a front surface of the frame to an inner surface of the frame, and wherein the discharge cover comprises a second bearing communication hole that extends from the inner surface of the discharge cover to a rear surface of the discharge cover, the rear surface of the discharge cover facing the first bearing communication hole.

10. The linear compressor of claim 9, wherein the second bearing communication hole is in fluid communication with the first discharge hole and the second discharge hole.

11. The linear compressor of claim 9, wherein a diameter of the second bearing communication hole corresponds to a diameter of the first bearing communication hole.

12. The linear compressor of claim 9, further comprising a first sealing member disposed between the frame and the discharge cover and configured to block refrigerant passing through the first bearing communication hole from leaking into a space between the frame and the discharge cover.

13. The linear compressor of claim 9, wherein the second bearing communication hole extends along a direction inclined by a predetermined angle with respect to the rear surface of the discharge cover.

14. The linear compressor of claim 8, wherein the first discharge plenum comprises:

a first contact member that is in contact with the inner surface of the discharge cover; and at least one partition member that partitions the inner space of the discharge cover into the plurality of discharge spaces.

15. The linear compressor of claim 14, wherein the first discharge plenum defines a coupling groove between the first contact member and the at least one partition member, and wherein a rear end of the second discharge plenum is disposed in the coupling groove.

16. The linear compressor of claim 12, further comprising a second sealing member disposed between the frame and the discharge cover and configured to block leakage of the refrigerant from the plurality of discharge spaces into the space between the frame and the discharge cover.

* * * * *